United States Patent [19]

Leslie et al.

[11] 4,154,158

[45] May 15, 1979

[54] METHOD AND APPARATUS FOR BINDING AN ARTICLE WITH A LOOP OF TENSIONED STRAP

[75] Inventors: John H. Leslie, Winnetaka; George A. Crosby, Long Grove, both of Ill.

[73] Assignee: Signode Corporation, Glenview, Ill.

[21] Appl. No.: 835,647

[22] Filed: Sep. 22, 1977

[51] Int. Cl.[2] ..... B65B 13/02

[52] U.S. Cl. ..... 100/2; 100/4; 100/26; 10/29; 100/32

[58] Field of Search ..... 100/2, 26, 29, 30, 32, 100/33, 4

[56] References Cited

U.S. PATENT DOCUMENTS

| | | | |
|---|---|---|---|
| 3,269,300 | 8/1966 | Billett | 100/26 X |
| 3,447,447 | 6/1969 | Rutty | 100/30 X |
| 3,636,861 | 1/1972 | Weller | 100/26 X |
| 3,674,972 | 7/1972 | Stahnke | 100/33 X |
| 4,011,807 | 3/1977 | Kobiella | 100/29 X |

*Primary Examiner*—Billy J. Wilhite

*Attorney, Agent, or Firm*—Dressler, Goldsmith, Clement, Gordon & Shore, Ltd.

[57] ABSTRACT

A method and apparatus is disclosed for binding an article with strap. A strap is encircled about the article to form a loop with the leading end segment of the strap overlapping an adjacent segment of the strap. The leading end is gripped to prevent further feeding and to subsequently restrain it against movement relative to the article while the trailing portion of the strap is retracted to draw the loop tight around the article. While holding the leading end segment of the strap and an adjacent overlapped segment against relative movement and under tension, either (1) a joint is first formed in the overlapping segments and the tension is then gradually released in the trailing portion of the strap to avoid shock loading of the joint and the machine or (2) the tension is first released only in the trailing portion of strap and the joint is then formed with tension in at least the overlapped segment adjacent the strap free end. The preferred embodiment of the apparatus is used with metal strap and forms an interlocking slit-type joint in the overlapping strap segments with a notcher jaw assembly coacting with a notcher punch, both of which also function prior to joint formation to hold the overlapping strap segments together against relative movement and to maintain tension on the overlapped segment adjacent the strap free end while tension is released in the trailing portion of strap.

19 Claims, 12 Drawing Figures

METHOD AND APPARATUS FOR BINDING AN ARTICLE WITH A LOOP OF TENSIONED STRAP

BACKGROUND OF THE INVENTION

In the recent past, Signode Corporation, the assignee of the entire interest of the present invention, has developed several machines for feeding strap in a chute to form a loop around an article to be strapped and for tensioning the loop tight about the article. Typically, these machines also apply a seal to the tensioned loop or otherwise form a connection between the overlapping strap segments, and then sever the tensioned and sealed loop from the standing, or trailing, length of strap.

There are a number of ways to join the overlapping lengths of strap together. With metal strap, independent crimp-type seals may be applied around the overlapping lengths of strap or slits may be cut into the overlapping lengths of strap so that they interlock, under tension, and prevent the straps from separating. With plastic strap, the overlapping lengths of strap may be fused together by applying heat, either through the introduction of a separate heated member or as a result of friction that occurs when one of the lengths of strap is rapidly vibrated in contact with, and relative to, the adjacent length of strap.

Some types of strapping machines first form the joint with tension existing in the standing portion of the strap which trails the joint area and then subsequently sever the trailing length of strap. Other types of machines, while holding the overlapping lengths of strap together, first sever the trailing portion of the strap while it is still under tension and then form a joint in the overlapping strap lengths. In either case, the failure to relieve all tension in the trailing portion of the strap length prior to a subsequent step has certain deleterious effects. For example, in those machines where a joint is first formed and then the trailing portion of the strap is severed while under tension, the unbalanced reaction force, exerted upon the joint owing to sudden release of tension in the trailing portion of the strap upon severance, creates a sudden shock loading upon the joint which tends to loosen or otherwise degrade the integrity of the joint. In those machines that first sever the trailing portion of the strap while the trailing portion is still under some amount of tension, a similar impact loading results which can jar the mechanisms holding the overlapping strap lengths together which may then cause one to slide relative to the other under the influence of the tension existing in the loop. The effect is to reduce the final applied tension in the loop.

Equally as important, the impact loading on the machine per se resulting from the sudden release of tension upon severance of the strap is undesirable from the standpoint of machine component wear. This is important because the strapping machines are cycled as each article is strapped and thus, shock loading on the machine components is repeated with every article strapped.

With relatively low levels of loop tension, shock loading on the formed joints or the machine components is usually not a serious problem. However, with the advent of increasingly high loop tension levels, such shock loads are becoming more significant. In particular, high shock loads can cause the joints to become loosened or weakened. Thus, it would be desirable to provide a method and apparatus for forming such an interlocking slit-type joint in metal strap wherein the joint and machine are not subjected to impact or shock loading upon release of the tension in the trailing portion of the strap. With some methods in use today, the joint is formed in an untensioned section of the loop and a loss of tension is experienced when the joint is subsequently subjected to full tension. It would be desirable to form a joint under tension so that little or no loss of tension occurs after the joint formation is completed.

Although machines exist for automatically strapping a package with metal strap and for forming a joint in the loop with an independent notch-type or crimp-type seal, and although machines exist for applying an interlocking slit-type joint to a loop of metal strap about a package, the applicant knows of no fully automatic machine which (1) encircles a package with a tensioned metal strap loop, (2) holds tension in the loop by pressing a punch member against the overlapped strap joint area, (3) with the same punch, forms an interlocking slit-type joint in the loop, while at least one of the overlapped strap lengths in the joint region is under tension, and (4) severs the trailing portion of the strap therefrom without subjecting the overlapping strap portions, the formed joint, or the machine per se to shock loading owing to sudden release of tension in the trailing length of strap. It would be desirable to provide a method and apparatus which could be used for strapping articles in such a manner as to form a joint with at least one of the strap lengths under tension and still avoid imposition of shock loading. Further, it would be desirable if such a method and apparatus were specifically adapted for use with metal strap and the formation of an interlocking slit-type joint therein.

With automatic strapping machines wherein the strap is first encircled about the package and sealed with an independent crimp-type seal or, if plastic strap is being used, sealed by fusion, it has been necessary to provide a separate anvil member or strap gate between the package and the sealing unit to provide a sufficient bearing surface against which the overlapping strap lengths are pressed in response to the action of the sealing or joint forming member. The use of a separate anvil or strap guide gate between the package and the overlapping strap lengths thus introduces some amount of slack into the tensioned loop. When this anvil or gate is subsequently removed from between the package and the strap after the joint has been formed, the residual loop tension is decreased. Thus, it would be desirable to provide an apparatus for forming a joint in overlapping lengths of strap wherein a separate anvil or gate can be eliminated.

In strapping machines in use today, a number of methods are employed to terminate the strap feeding process once a complete loop has been formed with the strap and after the strap leading end segment, or free end, has overlapped a portion of the loop. However, each of these methods has certain drawbacks.

In one method, a predetermined length of strap is fed by accurately controlling the feeding cycle of the machine. This involves accurately indexing the strap feed, or traction, wheel a certain number of rotations. Such a method requires complicated and expensive motors and control systems.

A second method requires feeding of the strap at a constant feed rate for a predetermined length of time. Such a method involves a timer control circuit and is inherently less reliable than the other methods that directly control the length of strap that is fed.

Another method for terminating the strap feeding process upon formation of the loop is to provide a motor cutoff limit switch actuated by a sensing lever in the strap chute, the lever being impinged by the strap free end after formation of a complete loop. Machines that employ a strap feed termination system with a limit switch and sensing lever typically have the lever located "ahead" of the strap sealing unit. Such machines rely upon motor momentum to feed the strap free end beyond the sensing lever and into proper alignment with the sealer unit.

Regardless of which method is employed, there is a tendency, after the strap leading end has come to rest, for the strap loop to flex inwardly under its own elasticity and pop out of engagement with the strap chute (especially at "corners" of non-circular chutes). This reduces the size of the loop slightly and effectively forces the strap leading end to slide beyond its original stopping point. The amount of such "self-feeding" can be as much as four inches in typical strapping machines and may produce an undesirable amount of overlap. Since the amount of "self-feeding" is dependent, at any instant, on the precise force with which the strap is fed into the chute by the feed wheel, upon the amount of dirt buildup in the chute, etc., the amount of "self-feeding" cannot be easily predicted and controlled from cycle to cycle. Thus, it would be desirable to provide a method and apparatus for gripping the strap leading end upon the termination of the power feeding step to prevent subsequent strap self-feeding and excessive overlap.

SUMMARY OF THE INVENTION

The method of the present invention involves binding an article with a loop of tensioned strap and forming a connection between overlapped strap segments in the loop. The method has been developed in recognition of the fact that shock loading of the overlapping lengths of strap, of the joint formed between overlapping lengths of strap, and of any machine used to strap articles must be eliminated if the undesirable reductions of loop tension, degradation of joint integrity, or damage to machine components are to be avoided.

According to the method of the present invention, a strap is first encircled about an article to form a loop with a leading end segment of the strap overlapping an adjacent segment of the standing portion of the strap. Next, as the powered strap feeding is terminated, the leading end segment of the strap is gripped to (1) prevent excessive overlap due to "self-feeding" and (2) restrain it against movement relative to the article while the trailing portion of the strap is retracted to tension the strap and draw the loop tight about the article. Then the leading end segment and an adjacent overlapped segment are held together and restrained against relative movement so that either (1) the joint can be first formed with the loop and at least one of the overlapping segments under tension and then the tension in the trailing portion of the strap can be gradually released to avoid shock loading of the formed joint and any apparatus that may be employed to effect this method or (2) the strap tension can first be released in the trailing portion of strap and the joint subsequently formed with the loop and at least one of the overlapping segments still under tension. The trailing portion of the strap can be severed from the loop any time after all tension has been relieved from the trailing portion so that the joint, as well as any apparatus used to effect this method, is not subjected to a significant sudden unbalanced reaction force.

It is important to note that by the method of the present invention, at least one of the two overlapping strap lengths in the joint area under the punch is subjected to full loop tension during joint formation. This tension is transmitted along the strap and exists throughout the strap loop, beginning at the gripped, leading strap end and terminating at the adjacent overlapped strap segment under the punch. This loop portion of the strap is to be distinguished from the trailing portion of strap which could be completely untensioned at this step of the process. Since the joint per se is formed with at least one of the strap lengths under tension, there is little loss of tension during the joint formation. With the present methods or apparatus that hold tension in the loop at locations away from the joint area and/or that form the joint in a completely untensioned section of the loop, some loss of tension can occur when the joint is subsequently subjected to the applied loop tension. To overcome this problem, a higher initial tension must be applied to the loop. This is undesirable since a higher than necessary tension can cause damage to the article being strapped.

The preferred embodiment of the apparatus for effecting the method of the present invention is used with metal strap and forms an interlocking slit-type joint in the overlapped lengths of strap. The apparatus has a traction wheel assembly which feeds the strap to form a loop about the article and has gripper jaws which grip the strap leading end to prevent excessive overlap due to "self-feeding". The traction wheel assembly is also adapted to subsequently reverse rotation to draw the loop into tight engagement about the article while the leading end is still held by the gripper jaws. The apparatus further has a unique high tension assembly which automatically, in response to completion of the initial loop tightening sequence, applies high tension to the trailing portion of strap. A novel notcher jaw assembly and opposed notcher punch are provided to impress the overlapping lengths of strap therebetween and hold them against relative movement and under tension on the overlapped segment adjacent the strap free end so that the tension can then be released from the trailing portion of strap. Following release of tension from the trailing portion of strap, the same notcher punch is forced further against the overlapping strap lengths, pressing the lengths against the notcher jaw assembly even harder, to cut an array of slits which, after retraction of the notcher punch, interlock in response to loop tension, to form a complete joint. A cutter blade is movable with the notcher punch to sever the trailing strap length from the loop as the joint is completed. The notcher jaws are uniquely designed to provide an anvil function with respect to the overlapping lengths of strap which are forced thereagainst by the notcher punch. These jaws eliminate the need for a separate anvil strap guide gate which could introduce unwanted slack into the loop. Thus, for a given applied strap tension, a higher residual loop tension can be maintained.

The method and apparatus of the present invention are thus seen to avoid the imposition of significant shock loading on the strap loop joint, as well as on the apparatus. However, it should be noted that the method and apparatus of the present invention also reduces the "tension loss" which can occur with other methods and other types of apparatus that do not employ the novel punch of the present invention to form the joint under full loop tension.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
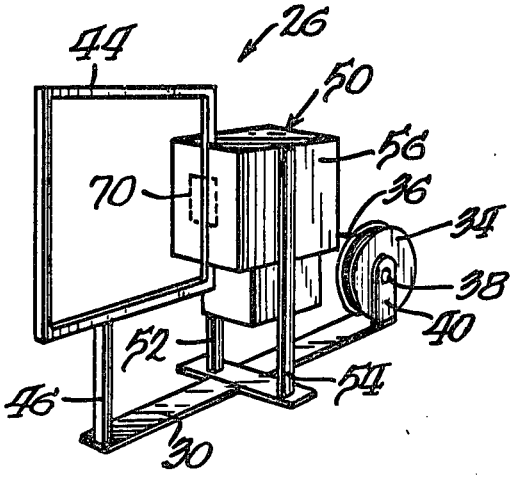
FIG. 1 is a perspective view of a preferred embodiment of the apparatus of the present invention.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated. The scope of the invention will be pointed out in the appended claims.

For ease of description, the apparatus of this invention will be described in normal operating position, and terms such as upper, lower, horizontal, etc., will be used with reference to this normal operating position. It will be understood, however, that apparatus of this invention may be manufactured, stored, transported and sold in orientation other than the normal operation position described.

The apparatus of this invention has certain conventional drive mechanisms and control mechanisms which, though not fully illustrated or described, will be apparent to those having skill in the art and an understanding of the necessary functions of such drive mechanisms causing proper operation of the apparatus in the manner as will be explained.

Many of the figures illustrating the preferred embodiment of the apparatus of the present invention show structural details and mechanical elements, which will be recognized by one skilled in the art, but the descriptions of which are not necessary to an understanding of the invention and, accordingly, are not herein presented.

The preferred embodiment of the strapping apparatus in accordance with the present invention is designated generally as 26 in FIG. 1. A base frame 30 is provided to support, in proper orientation, three major components of the apparatus. One component is the spool or reel 34, on which is wound a supply of strap 36, and which is mounted for rotation about a horizontal axis 38 which is supported by post 40. A second major component of the apparatus is the strap chute 44 which is a ring-like structure supported by post 46 and serves to guide the strap 36 around its periphery to encircle a package (not shown) which may be placed within the strap chute 44. The package can be moved into the strap chute 44 by hand or automatically by suitable conveyor means (not shown). A third major component of the apparatus 26 is the strap drive and sealing unit 50 which is supported on either side by posts 52 and 54. The individual mechanical and electrical components compising the strap drive and sealing unit 50 are typically enclosed within a sheet metal housing 56 to protect the individual components from ambient environmental conditions, to protect personnel from electrical and moving parts, and to provide a pleasing appearance.

The particular arrangement illustrated in FIG. 1 of the three major components (the strap chute 44, the strap drive sealing unit 50, and the strap reel 34) is well known in the strapping art. Such an arrangement can be used with metal strap, with plastic strap, and with plastic-coated metal strap.

In general, the strap 36 is fed through the strap drive and sealing unit 50 into the strap chute 44 so that the free end of the strap 36 travels completely around the chute and overlaps a portion of the strap to form a loop. Then the free end of the strap is gripped to prevent strap overfeed and the trailing portion of the strap is pulled, by appropriate mechanisms within the strap drive and sealing unit 50, to tighten the loop about a package with a particular desired tension level. Next, the overlapped portions of strap are joined by any one of a number of methods and the trailing portion of strap is severed from the loop so that the strapped package can be removed from the chute 44. Depending on the particular type of mechanisms used in the strap drive and sealing unit 50, it is possible to form the following types of joints in the overlapped strap portions: (1) an independent, metallic crimped or notched seal applied to metal strap, (2) an interlocking slit-type joint which is notched into metal strap, and (3) a heat fused joint in plastic strap effected by friction through high frequency vibratory members or effected by direct contact with a heated member.

The method of the present invention involves operations on the strap loop in the region of the strap overlap and in the region of the trailing portion of the strap. These regions are typically encompassed by, or contained within, the strap drive and sealing unit 50. The apparatus of the present invention, which effects the method of the present invention, involves a particular novel configuration of the components which make up the strap drive and sealing unit 50. Thus, for the most part, the balance of the description of the preferred method and apparatus of the present invention will be confined to operations performed on the strap, and mechanisms for effecting these operations, in the strap drive and sealing unit 50.

Typically, in the past, methods and apparatus for forming a strap loop and then subsequently tensioning, joining, and severing the strap have been performed in the sequence wherein the joint is formed in the overlapping strap lengths while strap is held under tension. Then after the strap loop joint is formed, the tension is either immediately released and the trailing portion of strap severed, or the trailing portion of strap is severed while still under tension. In another method, the trailing strap tension is partially rapidly released after which the strap is severed and the loop joint formed.

In any case, the effect is to suddenly release the tension in the trailing portion of the strap and this has deleterious consequences: (1) the strapping machine is subjected to shock loading due to the reaction of the part of the machine which had been gripping or applying tension to the trailing portion of the strap and (2) the joint or the overlapping lengths of strap in the joint are subjected to a sudden release of tension on one side of the joint area which, owing to the applied tension still remaining in the strap loop, causes a sudden shock loading on the joint and tends to loosen the loop, or otherwise degrade the integrity of the formed joint. With low tension levels, the presence of the shock loading is not a particularly serious problem. However, recently, with the use of strapping machines to strap articles requiring much higher tension levels, the shock loadings on the joint and on the machine itself, have become undesirable.

METHOD OF THE PRESENT INVENTION - GENERAL

Figure 2:
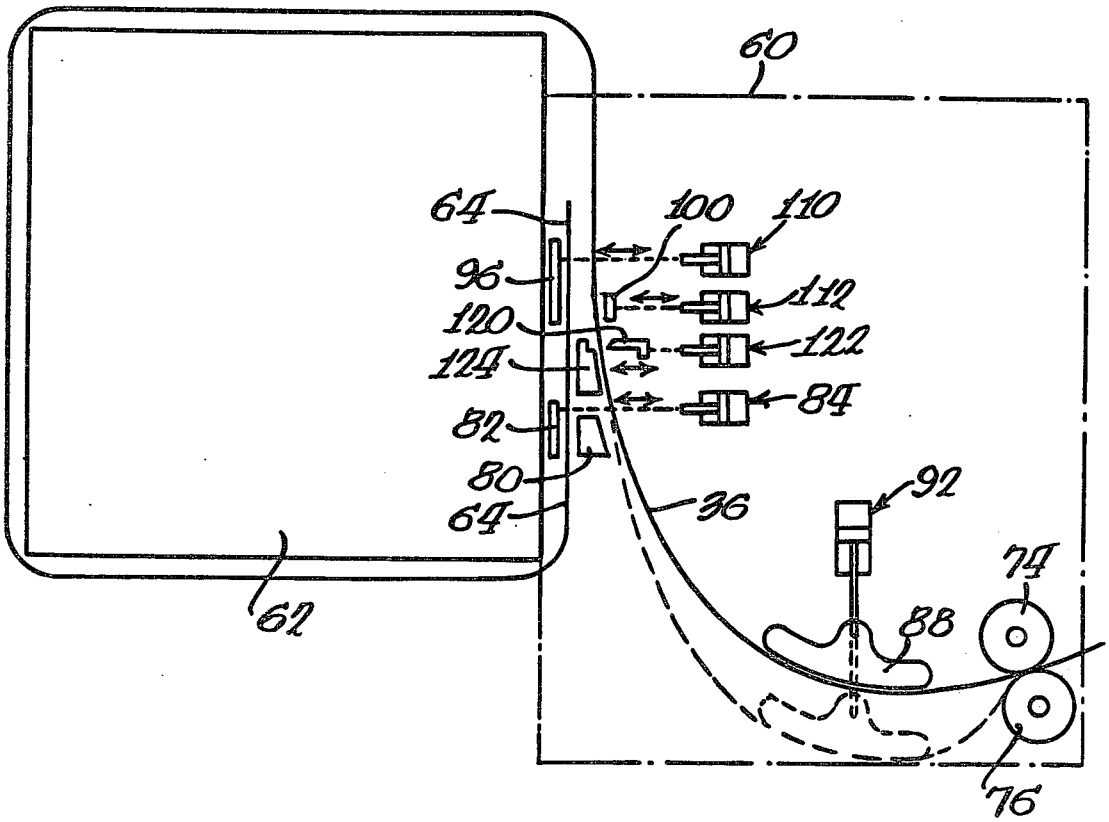
FIG. 2 is a simplified, schematic diagram of some major elements of a general embodiment of the apparatus of the present invention.

The method and apparatus of the present invention forms a joint in overlapping strap lengths in a region where at least one of the lengths is under full loop tension, eliminates the shock loading of the strapping machine and of the strap loop joint, and further prevents strap overfeed during the initial loop forming sequence. The method is most easily described with reference to the schematic illustration of a general embodiment of an apparatus of the present invention as shown in FIG. 2. The dashed box 60 represents an enclosure around the strap drive and sealing unit, such as unit 50 illustrated in FIG. 1. A length of strap 36 is shown passing through the enclosure 60 and forming a loop around a package 62 wherein the strap free end 64 overlaps a portion of the strap loop. Typically, the strap 36 is formed into a loop by being fed around the outside of the package 62 in a strap chute, such as the strap chute 44 illustrated in FIG. 1. For simplicity, the strap chute is not represented in FIG. 2.

The various gripping, sealing, and severing operations performed on the strap 36 are all performed in a small area near the front of the strap drive and sealing unit 50 in the region of the strap overlap. This region is shown by dashed lines 70 in FIG. 1 and of course, though not marked by dashed lines in FIG. 2, is adjacent the right side of the package 62.

As illustrated in FIG. 2, the strap 36 is fed from right to left through the strap drive and sealing unit (enclosure 60) to form a loop around the package 62. Though the manner of feeding is irrelevant to the method of the present invention, the strap is typically fed by traction wheels 74 and 76 in contact with the side surfaces of the strap 36. The strap 36 is maintained in contact with the traction wheels 74 and 76 by having wheel 76 spring-biased towards the traction wheel 74. Though not specifically illustrated in FIG. 2, appropriate guides or guideways within the strap drive and sealing unit function to guide the strap 36 through the unit and into a strap chute wherein the loop is formed about the package 62.

Next, according to the method of the present invention, the strap free end or leading end segment 64 is gripped to prevent strap overfeed and to restrain it against movement relative to the package 62. In FIG. 2, the means for gripping the leading end segment 64 is schematically illustrated as a coacting fixed anvil surface 80 and a gripper member or jaw 82 which is movable by an appropriate drive means, such as a pneumatic piston and cylinder actuator 84. The gripper jaw 82 is moved towards the right by actuator 84 to force the leading end segment 64 against the anvil surface 80 so as to hold it therebetween.

With the strap end gripped, the strap 36 is then pulled to tighten the loop about the package 62. In FIG. 2, the strap 36 would be pulled from left to right through the strap drive and sealing unit (enclosure 60). This is typically done by reversing the rotation of the traction wheels 74 and 76.

After the slack has been removed from the loop and the loop is tightly engaged about the package 62 a higher tension can be applied to the strap, if desired. Such high tension can be applied with a movable strap guide 88 which can be moved, as by a pneumatic piston and cylinder actuator 92, to contact the strap 36 and force the strap in a direction to tension the strap even more (downwardly as illustrated by the dashed lines in FIG. 2) while holding the strap at a suitable point to prevent slippage relative to guide 88.

Once the high tension has been applied to the strap loop, the leading end segment 64 and an adjacent overlapped segment of the strap 36 must be held, or maintained against relative movement while a joint is formed between the segments in a region where the adjacent overlapped segment of strap 36 is held under tension and while the tension is released in the trailing portion of the strap. The overlapping strap segments can be held together, as schematically illustrated in FIG. 2, by a pivotable jaw member 96 and an opposing movable member 100. Members 96 and 100 are both movable by pneumatic piston and cylinder actuators 110 and 112, respectively. After pivotable jaw member 96 is pivoted into a closed or "anvil" position, the pneumatic piston and cylinder actuator 112 urges the member 100 towards member 96 and against the overlapping strap lengths therebetween to maintain the lengths of strap in surface-to-surface contact against relative movement.

Though the gripper jaw 82 and anvil 80 are illustrated in FIG. 2 as being inwardly of members 96 and 100 (with respect to the leading end of the strap), it is to be understood that the method of the present invention could be effected with the jaw 82 and anvil 80 located outwardly of the members 96 and 100.

At this point, it is to be noted that the length of strap 36 that stretches between the high tension movable strap guide 88 and the members 96 and 100 is still under high tension. Further, the length of strap comprising the strap loop, from the point where it is held by the gripper jaw 82 to the point where it is held between the jaws 96 and 100, is also under high tension. Sudden release of the tension upon a formed joint is to be avoided to prevent degradation of joint integrity and shock loading of the machine. According to the method of the present invention, two alternatives are available: first, the overlapping lengths of strap can be joined while one of the lengths is under the high tension and then the tension can be *slowly* released to avoid shock on the joint and machine, or, secondly, all tension can be first released from the trailing portion of the strap while tension is still maintained in both the strap loop and in at least one of the strap lengths in the overlapping region and then the joint can be formed.

The first alternative will now be considered. With the overlapping lengths of strap held together between members 96 and 100, a joint or connection between them can be made by a number of methods. For example, an independent mechanism (not illustrated) can be moved into position immediately above the members 96 and 100 to apply an independent crimped seal around the overlapping lengths of strap. Alternatively, if the strap 36 is plastic or a plastic-coated metal, then the overlapping strap lengths could be fused together by the application of heat introduced by a separate heated member (not illustrated). Preferably, however, the members 96 and 100, in addition to serving to hold the overlapping lengths of strap together with at least one length under high tension, can also be operated to coact in such a way as to form a joint between the overlapping lengths of strap. For example, members 96 and 100 could be provided with coacting teeth for forming an interlocking slit-type joint. With such a design, the step of the method of the invention of holding the strap leading end segment 64 and an adjacent overlapped segment against relative movement could be accomplished simultaneously with, and as part of, the step of forming the interlocking slits in the overlapping strap lengths. In any case, since in this first alternative the joint is formed in the strap loop with the trailing portion of the strap 36 under tension, the trailing strap tension must be then relieved *before* the strap is severed so that the formed joint is not subjected to the unbalanced reaction force upon strap severance which would otherwise be experienced as a shock load impact which could weaken or degrade the integrity of the joint and which could put undue stress on the machine components. In fact, when the tension is released in the trailing portion of the strap 36 before severance, the release must be made *slowly* to avoid shock on the joint. That is, an instantaneous release of strap tension would be equivalent to severance of the strap under tension and would subject the joint to the same shock loading. Accordingly, in an embodiment of the method of the present invention wherein an interlocking slit-type joint is first formed by coacting members 96 and 100, the tension would be subsequently slowly reduced in the strap length 36 by slowly returning the high tension movable strap guide 88 (with the pneumatic piston and cylinder actuator 92) from the position shown in dashed lines to the position shown by solid lines. Then, the members 96 and 100 could be opened by their respective actuators 110 and 112 to expose the newly formed joint. Since the tension would have been relieved on the trailing strap portion, the newly formed joint is not subjected to any shock loading from the trailing strap portion. Subsequently, the trailing strap can be severed from the strap loop by cutter blade 120 which can be attached to member 100 or can be operated by an associated pneumatic piston and cylinder actuator 122. Cutter block 124 is provided to cooperate with the cutter blade 120 and present a bearing surface against which the strap length 36 is forced in response to the cutting action. Of course, the strap could be severed before the members 96 and 100 are moved apart to expose the formed joint—so long as the strap is severed after the tension has been released from the trailing portion of the strap. If the trailing portion of the strap is severed before the tension has been released both the machine and the formed joint would experience a shock loading or impact from the sudden reduction in tension on the one side of the joint.

At this point the second alternative available to prevent shock loading of the machine and of the formed joint, according to the method of the present invention, will be discussed. In the second alternative, while the strap leading end segment and an adjacent overlapped segment are held and maintained against relative movement with the adjacent overlapped segment under loop tension, the tension on the trailing portion of the strap 36 is first released and then the joint is formed in the region of the overlapping segments. Specifically, with reference to FIG. 2, after a loop has been formed about the package 62 the leading end 64 is gripped while the trailing portion of the strap 36 is retracted, as by appropriate rotation of traction wheels 74 and 76, and then high tension is applied by operation of the strap guide 88 as has been previously described. Then members 96 and 100 are each moved to compress the overlapping strap lengths therebetween to maintain loop tension up to and including that point, and further, to restrain them against relative movement. Next, the tension is relieved from the trailing or standing portion of the strap by retracting the strap guide 88 with pneumatic piston and cylinder actuator 92. It is important that members 96 and 100 exert sufficient force upon the overlapping strap lengths to prevent movement of the overlapped length of strap relative to the leading end segment (and thus maintain tension in the entire loop, including in at least one of the overlapping segments in the joint region) when the trailing strap tension is thus relieved. With the overlapping strap lengths properly held, they can next be joined.

A separate joint forming mechanism (not illustrated) can be moved adjacent to members 96 and 100 to form the particular joint, which may be of the independent seal type, an interlocking slit type or, with plastic strap, a fusion type. Preferably, however, the joint is formed by members 96 and 100 per se while they are so engaged with the overlapping strap lengths. With metal strap, for example, the members 96 and 100 can have coacting teeth for forming an interlocking slit-type joint as previously described above for the first alternative sequence. With such a mechanism, members 96 and 100 can be first pressed against the overlapping strap lengths with a force sufficient to restrain them against relative movement and to hold at least one overlapping strap 36 in tension while the trailing strap tension is being released. Then, the members 96 and 100 can be forced closer together so that the teeth on each member cut into the overlapping strap lengths to form the interlocking slit-type joint. Subsequently, the standing portion of the strap length can be severed from the strap loop by cutter blade 120 coacting with cutter block 124. It is to be noted that since the tension has been released from the trailing portion of the strap length, no sudden shock load will be imposed upon the joint when the trailing portion of the strap is severed. Severance of the strap after the tension has been released also avoids the imposition of shock loading on the machine owing to the reaction of the unbalanced force imposed by the pneumatic piston and cylinder actuator 92 acting through the high tension movable strap guide upon strap length 36. That is, if the strap 36 were severed while under tension, the pneumatic piston and cylinder actuator 92 would no longer be balanced by an opposing and equal tension force in the strap and would therefore violently move the strap guide 88 to the limits of its allowable travel subjecting the associated components to high impact loading.

Regardless of the precise mechanisms used to form the joint, and regardless of the specific type of joint formed, a novel feature of the method of the present invention is the formation of the joint in the overlapping lengths of strap while the loop and at least one of the lengths is held under tension and with the trailing portion of the strap being relieved of tension at some point so that subsequent shock is not introduced into the machine or into the joint through the trailing portion of the strap length.

It is to be noted that when the joint is formed in a strap loop about a package, at least the overlapping strap segment adjacent the strap free end segment is held under tension in the joint region. Depending upon the shape of the package (e.g., rectangular, circular, etc.), and depending upon the surface properties of the strap and of the package to be tied with the strap, the amount of tension in the strap loop can vary throughout the loop. Specifically, with a square or rectangular package having relatively sharp corners, the bending of the strap around each corner serves as a region of relatively high frictional engagement. Under such circumstances, the tension in the strap loop on the side of the package containing the joint (where high tension is typically most directly applied) will be higher than the tension in the portions of the strap loop on the other sides of the package. In fact, the tension in the portion of the strap loop on the side of the package that is opposite the loop joint will typically have the lowest tension compared to the tension in the portions of the loop on the other three sides of the package.

In the context of the method of forming a joint in accordance with the present invention, and for purposes of the discussion in this specification and of the understanding of the appended claims, the term "under tension", when applied to the overlapping strap segments, refers to such applied, unreduced tension levels as may exist in one or both of the overlapping strap segments in the joint region after the strap has been tightened or tensioned with the maximum and final design "pull" force.

The method of the present invention, of forming a joint in a strap loop under tension and without subjecting the machine or formed joint to shock loading, can be effected through a number of specific alternative sequential steps. The specific step-by-step alternatives will now be considered in detail. It will be assumed in discussing each alternative sequence of steps that the strap has been encircled about a package, that the leading end of the strap has been gripped to restrain it against movement relative to the package, that the strap has been tightened about the package, and that the leading end segment and an adjacent overlapped segment of the strap are restrained against relative movement with at least the adjacent segment under tension. With those conditions obtaining as a starting point, the necessary subsequent sequential steps will be discussed. Specifically, four different sequences will be considered.

METHOD OF THE INVENTION - FIRST SEQUENCE

While continuing to hold the leading end segment and an adjacent overlapped segment of the strap in surface contact against relative movement with at least the adjacent segment under tension, a joint is first formed between the two segments. Next, the tension on the standing or trailing portion of the strap is gradually released to avoid shock loading of the machine and formed joint. After substantially all tension has been released from the trailing portion of the strap, the loop is severed from the balance of the standing portion of the strap which trails the formed joint.

METHOD OF THE INVENTION - SECOND SEQUENCE

In the second alternative sequence, the tension on the standing portion of the strap is released while continuing to hold both the strap leading end segment and an adjacent overlapped segment in surface contact against relative movement with at least the adjacent segment under tension. After all tension has been released from the trailing portion of the strap, the loop is severed from the balance of the untensioned trailing portion of the strap. Finally, a joint is formed between the overlapping strap segments.

METHOD OF THE INVENTION - THIRD SEQUENCE

In the third alternative, like in the second alternative, tension on the standing portion of the strap is first released while continuing to hold both the strap leading end segment and an adjacent overlapped segment in surface contact against relative movement with at least the adjacent segment under tension. But then, the joint is next formed in the overlapped segments, after which the loop is severed from the balance of the untensioned standing portion of the strap which trails the formed joint.

METHOD OF THE INVENTION - FOURTH SEQUENCE

In the fourth alternative, the tension on the standing portion of the strap is again first released while continuing to hold both the strap leading end segment and an adjacent overlapped segment in surface contact against relative movement with at least the adjacent segment under tension. Then, in the same motion, a joint is formed in the overlapping strap segments and the loop is severed from the balance of the untensioned standing portion of the strap which trails the joint forming area. That is, the step of forming the joint and the step of severing the loop from the trailing portion of the strap are not performed at separate points in time but are performed simultaneously.

Each of the four alternative sequences of steps effects the method of the present invention in that (1) an article is encircled with a strap loop, (2) the strap loop is tensioned about the article, and (3) a joint is formed in the overlapping strap segments with the loop under tension and with at least one of the segments under tension, and (4) the tension is released on the trailing portion of the strap in a manner that prevents the formed joint and machine from being subjected to a shock loading due to sudden release of tension on the trailing portion of the strap.

It should be noted that in FIG. 2, the specific mechanisms for performing the individual operations (of gripping the leading end segment 64, retracting the strap to tension the loop, holding the strap leading end segment and an adjacent overlapped segment against relative movement, and severing the strap) are represented schematically and the mechanisms are located in FIG. 2 in a relative order which can be changed to accommodate the needs of the particular mechanisms and machine. For example, as previously discussed, the anvil surface 80 and gripper jaw 82 might be located closest to the distal end of the strap leading end segment 64. Also, with some types of machines, it might be preferable to locate the anvil surface 80 and gripper jaw 82 between the cutter block 124 and the jaw member 96. Also, in some embodiments, as in the preferred embodiment to be described hereinafter, the cutter blade 120 may be mounted on, and actuated with one of the joint forming members instead of separately. And, as has been suggested earlier, additional joint forming mechanisms may be introduced around the overlapped strap lengths, either above or below the members 96 and 100. Of course, the relative location of cutter blade 120 with respect to any joint forming mechanism must be such that the cutter blade is positioned to sever the loop from the balance of the standing portion of the strap which trails the formed joint.

PREFERRED EMBODIMENT OF THE APPARATUS FOR BINDING AN ARTICLE ACCORDING TO THE METHOD OF THE PRESENT INVENTION

The preferred embodiment of the apparatus for binding an article according to the method of the present invention is used to strap articles with metal strap and forms an interlocking slit-type joint in the overlapping strap segments in the loop. The apparatus performs the strapping sequence automatically and is uniquely constructed to apply a secondary high tension over a lower primary tension in the strap loop and yet release all tension on the length of the trailing strap before joint formation and strap severance. This of course, avoids shock loading of the formed joint. Specifically, the preferred embodiment of the apparatus is adapted to effect the method of the present invention according to the above-described "Fourth Sequence." The apparatus employs gripper jaws to hold the strap free end at the end of the power feeding cycle to prevent strap overfeed and to hold the strap during application of tension. The apparatus also incorporates a unique power-operated notcher punch and jaw assembly which serves two functions: (1) holding the overlapping strap lengths while tension is released on the trailing portion of the strap and (2) forming the interlocking slit-type joint. Use of the unique notcher punch and jaw assembly also eliminates the need for a separate movable strap guide gate on the front sealing or joint forming face of the apparatus.

The apparatus has the same major features as illustrated for a typical strapping machine in FIG. 1. The novel mechanisms of the present invention are located in the strap drive and sealing unit 50 which is more clearly illustrated in FIG. 3 wherein the housing 56 has been removed to more clearly show the individual components.

Figure 3:
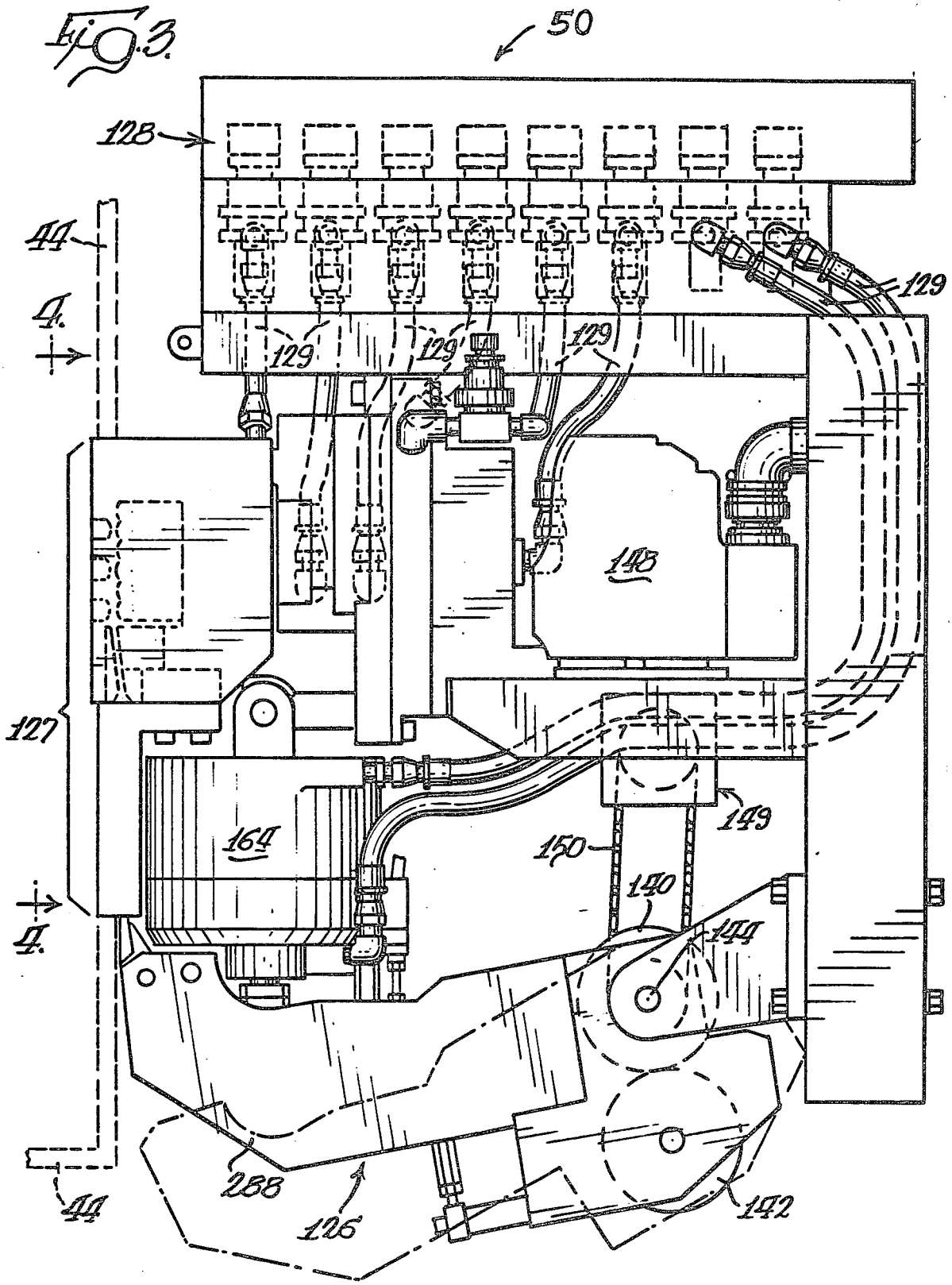
FIG. 3 is a side view of the portion of the apparatus shown in FIG. 1 with the exterior housing removed to expose internal components.

The major features of the apparatus will first be very briefly described to provide an overall perspective understanding of the apparatus. Referring now to FIG. 3, the strap is fed forward, retracted at low tension and subjected to high tension through the pivotable high tension assembly designated generally at 126 at the bottom of the unit. The strap is guided into overlapping orientation, gripped, joined, and severed along the left side of the apparatus in the bracketed region designated at 127. Operation of the various components to effect the tensioning, gripping, joint formation, etc., is by piston and cylinder actuators driven with pressurized air through a bank of solenoid valves 128 on top of the apparatus which supply air through appropriate hoses 129.

The path of the strap through the apparatus will next be briefly and generally described, along with certain major features or components of the apparatus. Subsequently, more detailed descriptions of each mechanism will be given.

The strap enters the strap drive and sealing unit 50 from the right as viewed in FIG. 3. The actual strap path is revealed in the sectional view of FIG. 5 where it can be seen that the strap enters a pair of short guide members 130 and 132 which direct the strap between traction wheel pairs 140 and 142. The traction wheel 140 is mounted on shaft 144 and driven by motor 148 through gear assembly 149 and chain drive 150. Both traction wheels 140 and 142 preferably have meshing ring gears (not illustrated) on one side through which traction wheel 142 is positively driven by traction wheel 140. By clockwise rotation the traction wheel 140 can feed the strap forward (from right to left as viewed in FIG. 5) between upper guide member 154 and lower guide member 156.

The strap is maintained within the space between the various guide members by two opposed, parallel side plates: plate 286 (FIG. 5) and plate 288 (FIG. 3). An opening 160 in the upper guide member 154 provides access to the strap surface for the high tension gripper 162 which is actuated by pneumatic piston and cylinder actuator 164. The operation of the high tension gripper and cylinder actuator will be described in further detail below in the section entitled "High Tension Assembly". On the left-hand end of the upper guide member 154 is a guide 170 which is pivotally mounted about pin 172 and is adapted for sliding between rear block 174 and front block 202.

As the strap leading end segment is fed through movable guide 170 it enters the channel 178 above guide 170, between blocks 180 and 182, which guides the strap into position adjacent a cutter blade 186 and between notcher jaw assembly 190 and notcher punch 196 above the blade. The specific structure and function and operation of the cutter blade, notcher jaws and notcher punch, as well as their actuating mechanisms, will be discussed in more detail hereinafter. During initial feeding of the strap, the leading end segment passes out of the top of the strap drive and sealing unit 50 and enters the strap chute 44 as illustrated in FIG. 1. The leading end segment travels around the chute 44 in a counterclockwise direction as viewed in FIG. 1 to form a complete loop as it enters channel 200 between block 202 and gate plate 226 in block 174. Channel 200 is parallel to, and directly in front of, movable guide 170. The strap free end or leading end segment is fed until it protrudes from channel 200 so that it passes completely by block 180 a suitable distance beyond notcher punch 196 and notcher jaw assembly 190. Further movement of strap 64 is prevented by action of the gripper jaw assembly 210 against block 180 to thus prevent undesired strap "overrun". Description of the detailed structure, function, and operation of the gripper jaw, and its actuating mechanism, will be given in detail hereinafter.

The various individual components of the strap drive and sealing unit 50 will now be described in more detail. Each component will be described in the sequential order in which it functions according to the method of the present invention.

STRAP OVERLAP SENSING MECHANISM

Figure 4:
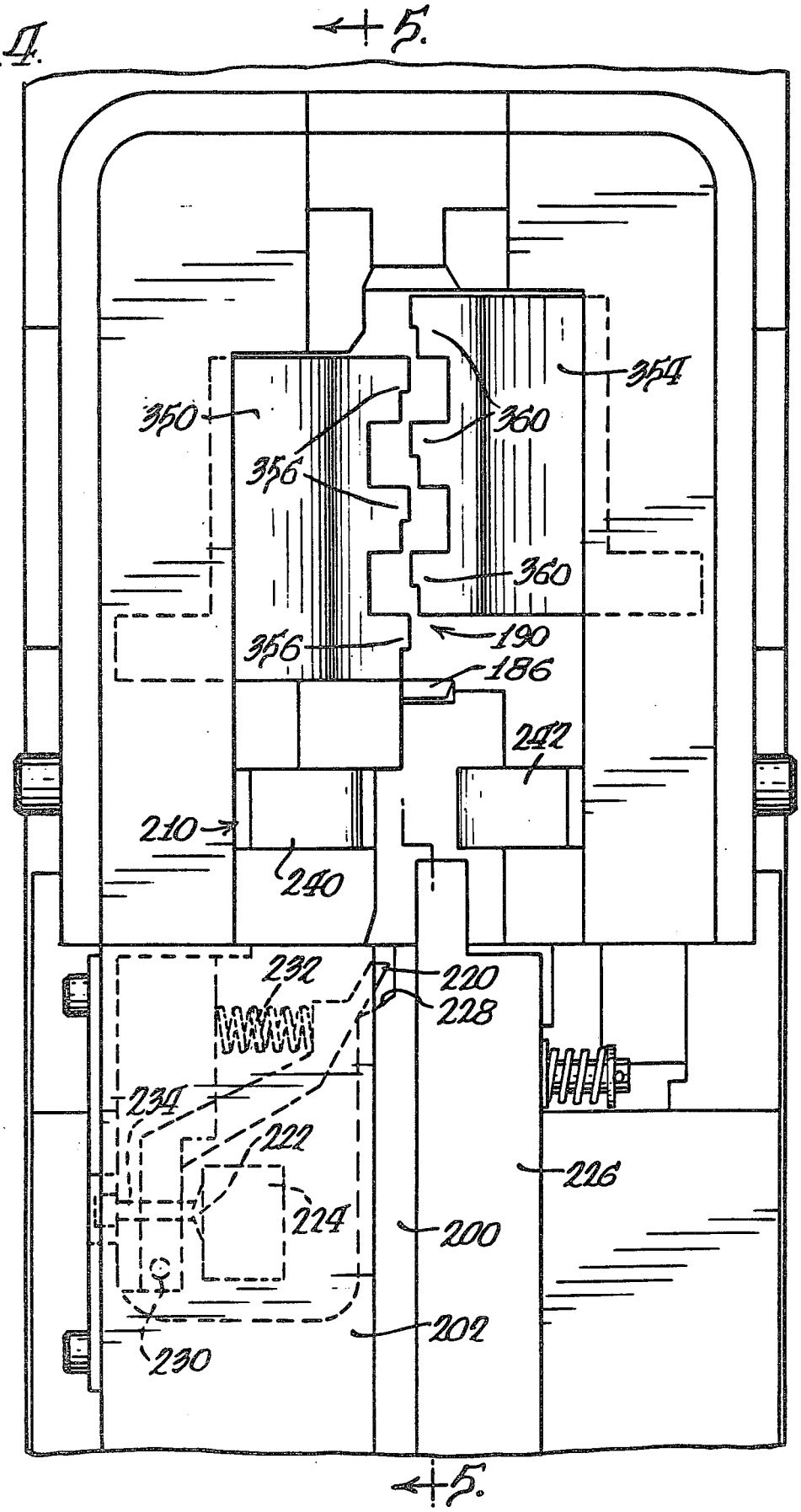
FIG. 4 is a partial, front view taken generally along the plane 4—4 of FIG. 3.

After the strap has been fed around the strap chute so that a portion of the loop is properly overlapped by the leading end segment of the strap, the feeding process must be terminated. In the preferred embodiment this is accomplished by means of a sensing lever connected to a limit switch which interrupts an electrical circuit of the motor which drives the traction wheel feeding the strap. With reference to FIGS. 1, 4, 5, and 6, it is seen that the leading end segment of the strap is guided by the chute 44 to form the loop and enter the strap drive and sealing unit 50 within open channel 200 in block 202. As best illustrated in FIG. 4, the channel 200 is open inwardly towards the article to be strapped and the opening is partially covered by gate plate 226 which serves to keep the strap leading end segment from falling inwardly out of channel 200.

Specifically, as viewed in FIG. 4, gate plate 226 extends over the right half of the channel. Plate 226 is movable to the right and away from the channel by suitable means not illustrated, to expose the strap and allow it to lie flat against the package during tensioning.

Block 202 has a notched area 228 in the bottom wall of channel 200 to accommodate the distal end of a strap sensing lever 220 which projects into the channel 200. The strap sensing lever 220 is pivotally mounted about pin 230 and biased by spring 232 into the channel 200. A screw 234 is secured to the lever 220 and arranged to actuate limit switch contacts 222 on limit switch 224. When the leading end segment of the strap passes upwardly in channel 200 and impinges upon the distal end of the strap sensing lever 220, the lever is rotated counterclockwise, as viewed in FIG. 4, about pin 230 thereby actuating the limit switch 224. Through suitable timing devices and controls, the leading end of the strap is allowed to continue upwardly so that it feeds past the gripper jaw assembly 210 and past the region between the notcher jaw assembly 190 and the notcher punch 196 to a predetermined distance beyond the top of the notcher punch 196. Conventionally, this further movement of the leading end segment of the strap is effected by immediately switching off power to the motor upon actuation of the limit switch and allowing the motor momentum to continue rotating the traction wheel to feed the strap the desired amount, by which time the motor rotation has terminated. It has been previously noted that the strap loop has a tendency to flex or pop inwardly and out of the strap chute under the influence of its own stiffness so that the loop size decreases slightly and so that the strap leading end segment is pushed further upwardly to a position of greater overlap. In the apparatus of the present invention, this is prevented by a unique use of gripper jaws as will be explained in the next section.

GRIPPER JAWS MECHANISM

Figure 6:
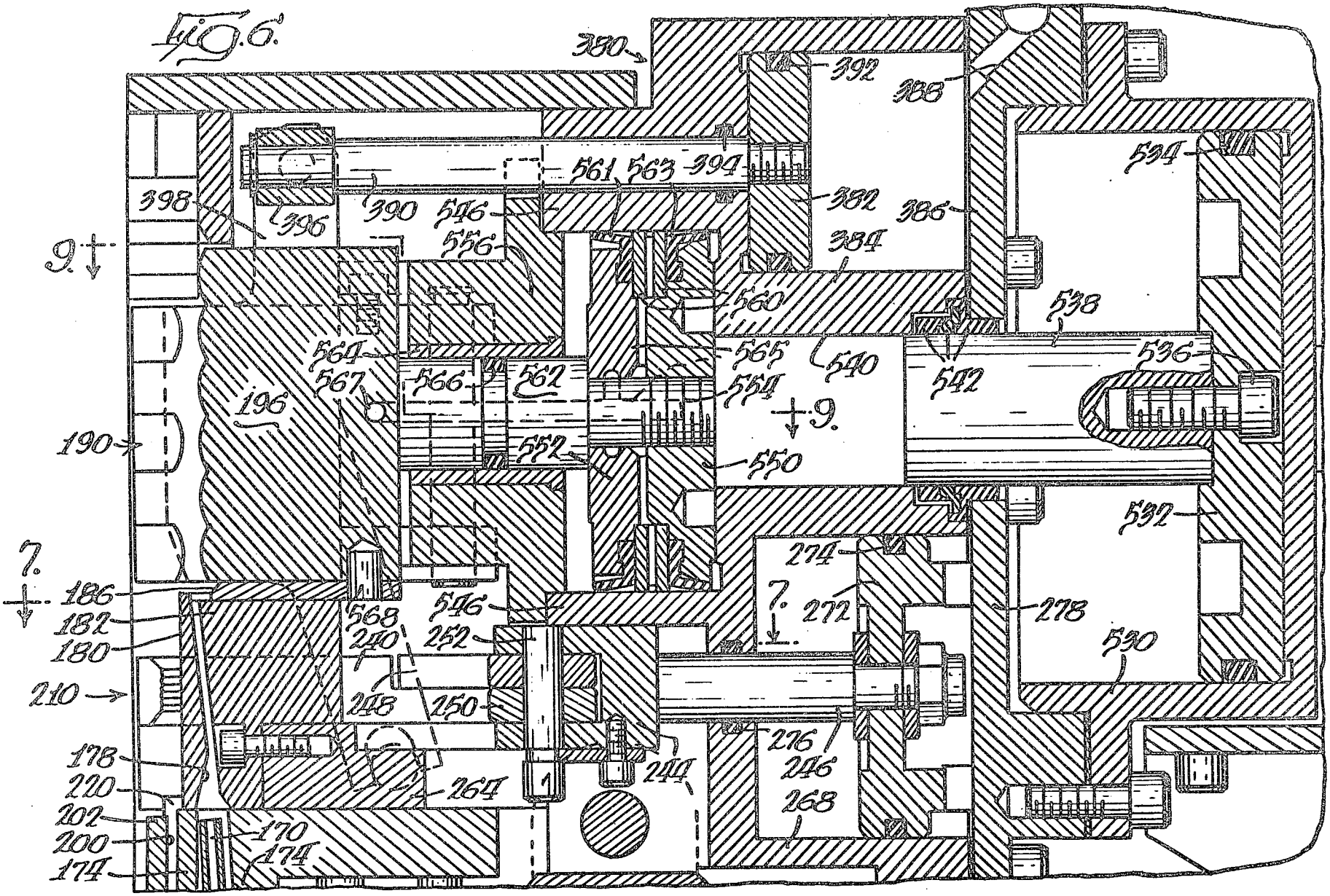
FIG. 6 is an enlarged, sectional view of the upper left hand corner portion of FIG. 5 showing the gripper jaw, notcher jaw and notcher punch mechanisms.
Figure 7:
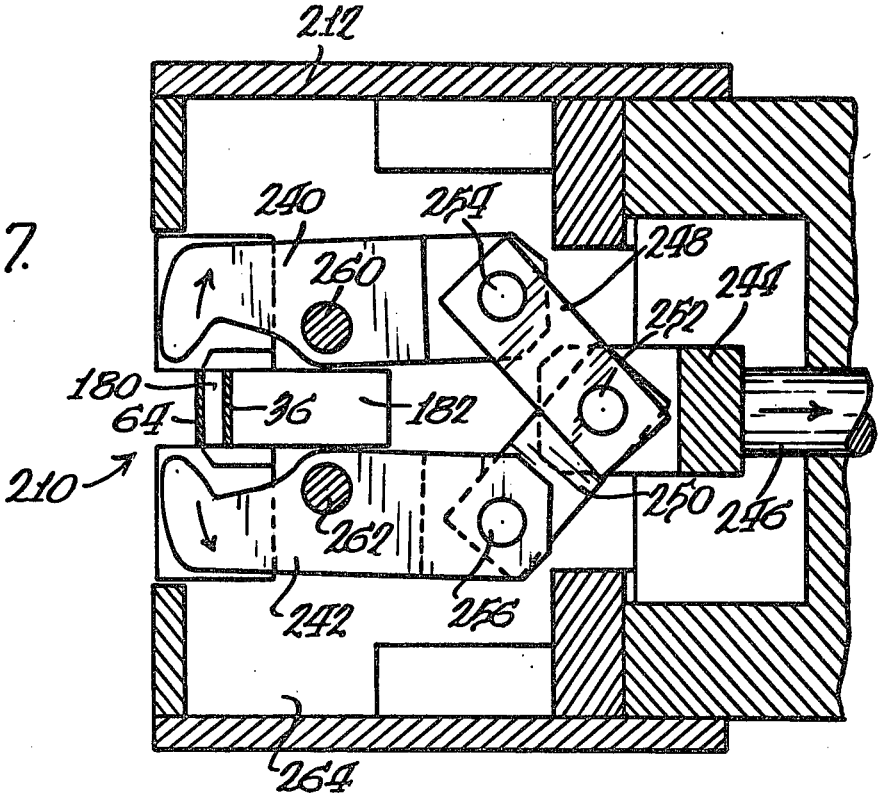
FIG. 7 is a sectional view taken generally along the plane 7—7 of FIG. 6 showing the gripper jaws in the open position.
Figure 8:
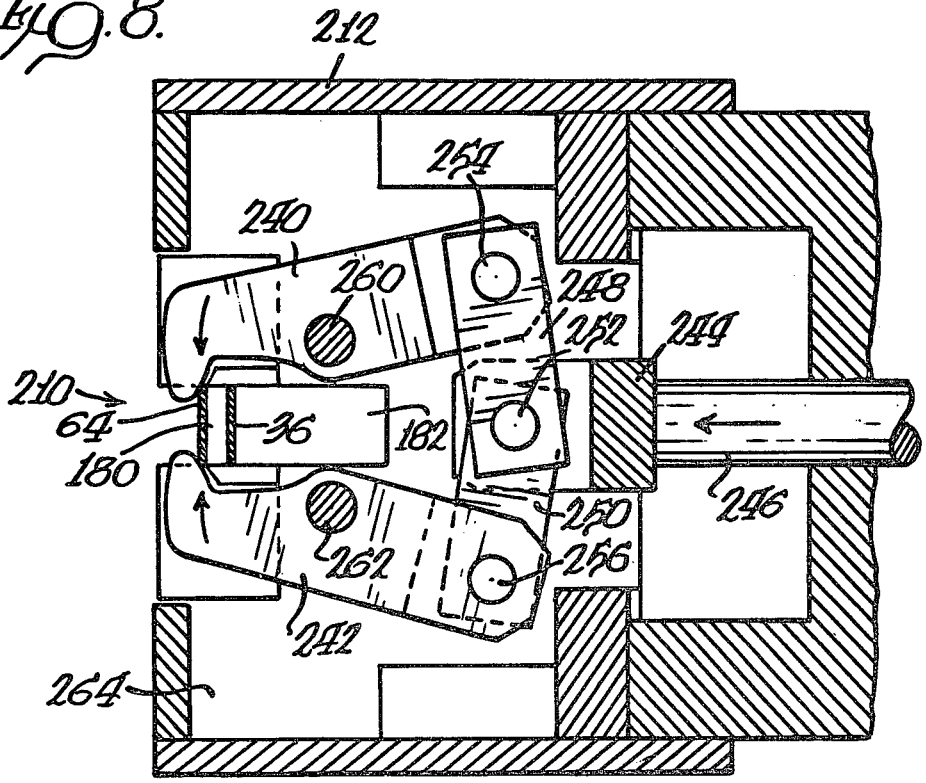
FIG. 8 is a view similar to FIG. 7 showing the gripper jaws in the closed, or gripping, position.

In response to the actuation of the strap sensing limit switch and after a suitable time delay, the leading end segment is gripped by a gripper jaw assembly just as the feed motor comes to rest. The time delay is set to actuate the gripper jaw assembly before the loop starts to pop inwardly out of the strap chute. This then prevents further "self-feeding" and maintains the leading end segment of the strap with the proper amount of overlap. The gripper jaws continue to hold the strap end segment to restrain it against movement relative to the package so that the loop can be subsequently tightened or tensioned about the package. In the previous description of the method of the present invention, the leading end segment of the strap was gripped (as illustrated in FIG. 2) by gripper jaw 82 which forces the leading end segment 64 against the anvil surface 80. In the preferred embodiment of the apparatus, a gripper jaw assembly 210 is located above the strap sensing lever 220 and below the notcher jaw assembly 190 as illustrated in FIGS. 4 and 6. The assembly 210 is of a conventional scissors-type construction and is contained within a space defined by wall structure 212 as is best illustrated in FIGS. 7 and 8.

Two gripper jaws 240 and 242 are supported by base plate 264 through pivot pins 260 and 262 which are anchored therein. Jaws 240 and 242 are connected to clevis 244 on rod 246 by means of links 248 and 250, respectively, both of which are pivoted to the clevis 244, as indicated at 252. Jaw 240 is pivotally connected to link 248 through pin 254 and jaw 242 is pivotally connected to link 250 through pin 256. Both jaws 240 and 242 are pivoted intermediate their length, as indicated at 260 and 262, respectively, so that both jaws move inwardly to a holding position when the rod 246 moves to the left (as viewed in FIG. 8) and so that both jaws move to an open position when the rod 246 moves to the right (as viewed in FIG. 7).

As is best illustrated in FIG. 6, link 248 is disposed over a stepped down portion of jaw 240. Link 250 is disposed beneath a stepped up portion of jaw 242 (not illustrated in FIG. 6 but indicated by dashed lines in FIG. 8).

The gripper jaw assembly 210 is ultimately actuated through rod 246 by a pneumatic piston and cylinder actuator comprising a cylinder portion 268 (as best illustrated in FIG. 6) and piston 272. A suitable seal, such as an O-ring 274, is disposed on a periphery of the piston 272. Similarly, leakage is prevented along the rod 246 by use of a suitable sealing device, such as O-ring 276 in the portion of cylinder structure 268 adjacent the rod 246. A removable cylinder 278 is provided at the end of the cylinder 268 opposite the rod 246 to form a complete airtight chamber. The piston and cylinder actuator is double-acting and pressurized air can be introduced on either side of the piston 272 by suitable apertures in the cylinder 268 (not illustrated). The pneumatic control system associated with the gripper jaw assembly actuator, as well as other pneumatic actuators, will be discussed in a separate section hereinafter.

Figure 5:
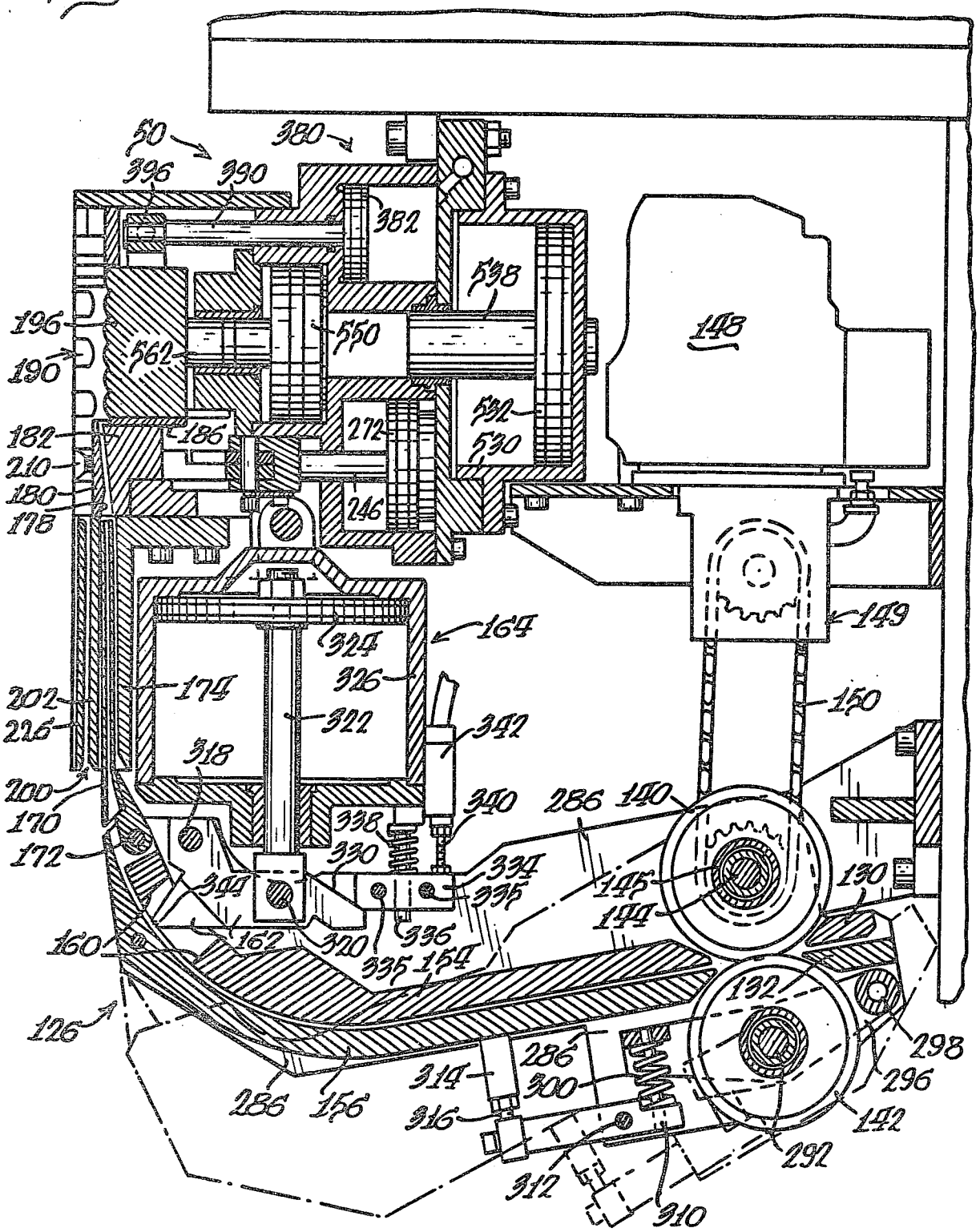
FIG. 5 is a sectional view taken generally along the plane 5—5 of FIG. 4.

As viewed in FIGS. 5 and 7, the trailing portion of the length of strap 36 is received within channel 178 between block 180 and block 182. The strap leading end segment 64 is disposed adjacent the left side of block 180. Thus, when the gripper jaws 240 and 242 are moved to the holding position as illustrated in FIG. 8, the leading end segment 64 is held against the block 180 while the trailing portion of the strap 36 is free to be retracted in the channel between blocks 180 and 182 during the tensioning process.

HIGH TENSION ASSEMBLY

After the leading end segment of the strap has been restrained against movement relative to the package by the gripper jaw assembly 210, the trailing portion of the strap can be retracted to draw the loop tight around the package and to apply an appropriate amount of tension to the strap. The high tension assembly 126, along with the traction wheels 140 and 142 and drive motor 148, perform this function.

When the strap first encircles the package in the strap chute, there is usually a substantial amount of space between the strap and the package. The size of the loop must be reduced by retracting the trailing portion of the strap 36. This is most easily done by rotating the traction wheel 140 in the counterclockwise direction (FIG. 5) to pull the strap length 36 from left to right. When the slack has been taken out of the loop, it may then be desirable to apply high tension to the loop. The high tension assembly 126 which operates to apply high tension to the loop is similar to that disclosed in the U.S. Pat. No. 3,493,014 to R. Orban et al., and attention is directed thereto. Just a very brief description will be presented here.

As previously described and as illustrated in FIG. 5, the strap is guided between guide members 130, 132, 154, 156 and 170 in the high tension guide assembly. These guide members are mounted between opposed parallel plates 286 (illustrated in FIG. 5) and 228 (illustrated in FIG. 3). The plates are pivotally mounted about the traction wheel shaft 144 to accommodate rotation between the position shown in solid lines in FIG. 5 to the position shown in dashed lines in FIG. 5. This rotation is used to effect high tension on the strap and is automatically initiated by increasing tension in the trailing portion of the strap length as the strap is being retracted by the traction wheels 140 and 142. This process will be hereinafter explained. First, however, the traction and idler wheel assembly will be described.

The strap is maintained between traction wheels 140 and 142 by a spring bias on the wheel 142. Wheel 142 is mounted about shaft 292 to underlying swing plate 296 which is in turn pivotally mounted about shaft 298 between opposed parallel plates 286 and 288. Swing plate 296 is secured on one end to spring 300 which biases the plate and traction wheel 142 against the traction wheel 140 to maintain appropriate gripping force on the length of strap impressed therebetween. The compression of spring 300 is adjustable by bar 310 which is pivotally mounted about shaft 312 secured to plate 286 and which on one end, abuts spring 300 and on the other end is secured to adjusting post 314 through an adjusting screw 316. By appropriate setting of the adjusting screw 316, bar 310 can be rotated about shaft 312 to increase or decrease the compression of spring 300 to thereby vary the force exerted upon the traction wheel 140 by the traction wheel 142.

As the trailing portion of strap is retracted by the traction wheels to pull the loop tightly around the package, the upper guide member 154 becomes subjected to an increasing amount of force being generated by the tension in the strap lying thereagainst. This force, acting through guide member 154, causes the attached parallel opposed plates 286 and 288 to rotate clockwise (as viewed in FIG. 5) about shaft 144 of the traction wheel 140. This rotation of the assembly about shaft 144 is mechanically sensed and used to initiate the high tensioning process. The high tensioning process is effected by cylinder actuator 164 acting through the high tension gripper 162. Specifically, gripper 162 is pivotally secured to plate 286 about pin 318 and is pivotally secured at pin 320 to rod 322 which is connected to piston 324 mounted in cylinder 326. Gripper 162 has a slanted bearing surface 330 which is adapted to engage bar 334 which is secured with bolts 335 to plate 286. A pin 336 is slidably received in bar 334 and is centered within helical spring 338 which biases the bar 334 downwardly along pin 336 into engagement with the slanted bearing surface 330 of the gripper 162. Mounted parallel to pin 336 on bar 334 is a screw 340 which is adapted to engage limit switch 342. Now, when the opposed parallel plates 286 and 288 (plate 288 is of course not visible in the section view of FIG. 5) rotate clockwise about shaft 144 under the influence of the low strap tension being pulled by the traction wheel 142, plates 286 and 288 carry bar 334 slidably and upwardly along pin 336, away from bearing surface 330 of gripper 162, thereby further compressing spring 338 and actuating limit switch 342 through screw 340. The limit switch 342 is connected to stop the motor 148 and simultaneously actuate the high tension sequence.

The cylinder actuator 164 is a double-acting pneumatically actuated device and has pressure ports (not illustrated) for admitting air on either side of piston 324. Through a suitable pneumatic control system which will be described hereinafter, pressurized air is admitted above piston 24 in response to actuation of limit switch 342. This causes the piston 324 to move downwardly within cylinder 326 to thereby begin the high tensioning sequence. First, it should be noted that since gripper 162 is pivotally mounted about pin 318, a downward movement of piston 324 and the connecting rod 322 tends to urge the gripper 162 to rotate clockwise about pin 318 to tightly engage the strap against the lower guide member 156. Further downward movement of the piston 324, acting through pin 318, moves the entire assembly of guides attached between plates 286 and 288 downwardly as the plates 286 and 288 pivot counterclockwise about shaft 144. As this occurs, movable guide 170 is drawn downwardly inside block 174 to provide for continuous guiding of the strap throughout its length.

The pressure within cylinder 326 is maintained above piston 324 at a desired predetermined level to effect the desired amount of tension within the strap. The cylinder is maintained in the pressurized condition to hold the high tension until the overlapping lengths of strap are grabbed between the notcher jaws assembly 190 and the notcher punch 196 as will be explained in the next section.

NOTCHER JAWS ASSEMBLY AND NOTCHER PUNCH MECHANISM

As was previously described, the strap leading end segment 64 is guided to form a loop in the strap chute 44 such that it enters the strap drive and sealing unit 50 (FIG. 5) at channel 200 and passes up past the gripper jaws assembly 210 adjacent to block 180 and then passes further upwardly into the region between the notcher jaws assembly 190 and the notcher punch 196 wherein it overlaps a portion of the strap loop.

After the strap leading end segment has been gripped by the gripper jaws and after high tension has been drawn on the strap, the jaws assembly and punch are then pressed together to hold the overlapping strap lengths against relative movement.

The notcher punch 196 and the notcher jaws assembly 190 actually perform two functions: (1) first restraining the overlapping strap lengths against relative movement while the high tension is released on the trailing strap portion and (2) subsequently forming an interlocking slit-type joint in the overlapping strap lengths. The type of interlocking slit joint formed by the coacting jaws and punch is that disclosed in the U.S. Pat. No. 3,303,541 to J. R. Beach, which is assigned to the assignee of the present invention. Reference to that patent is directed for detailed information regarding the configuration of the joint.

Figure 9:
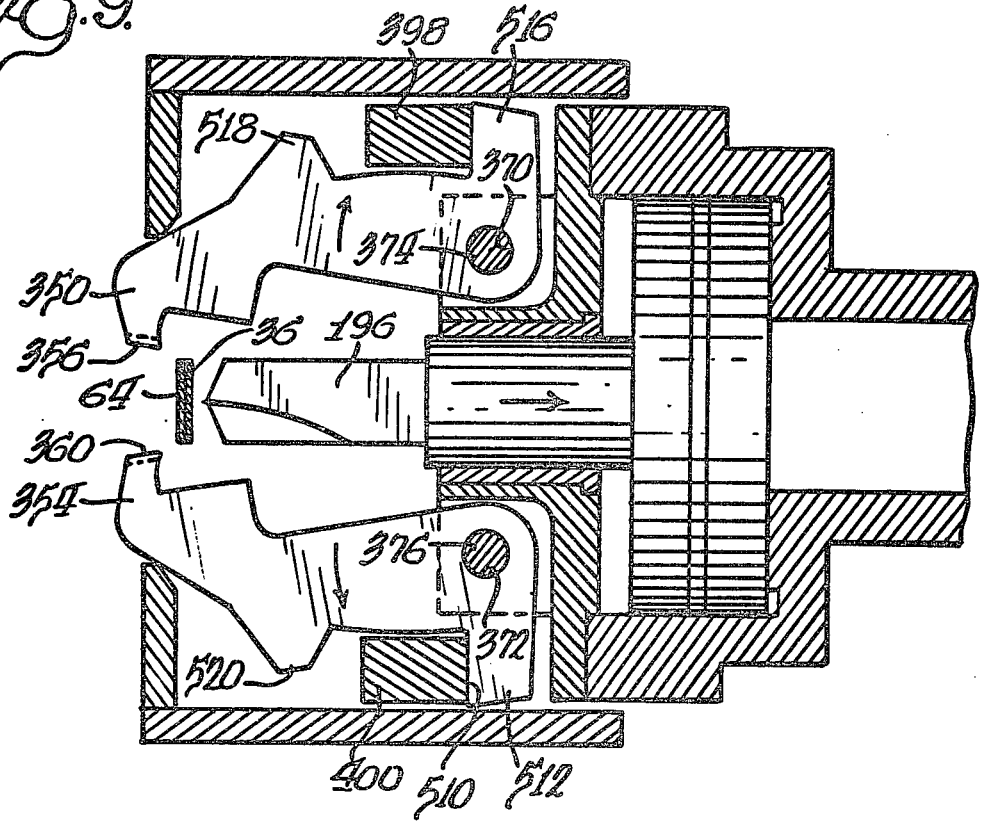
FIG. 9 is a sectional view taken generally along the plane 9—9 of FIG. 6 showing the notcher jaws and notcher punch in the open position.
Figure 10:
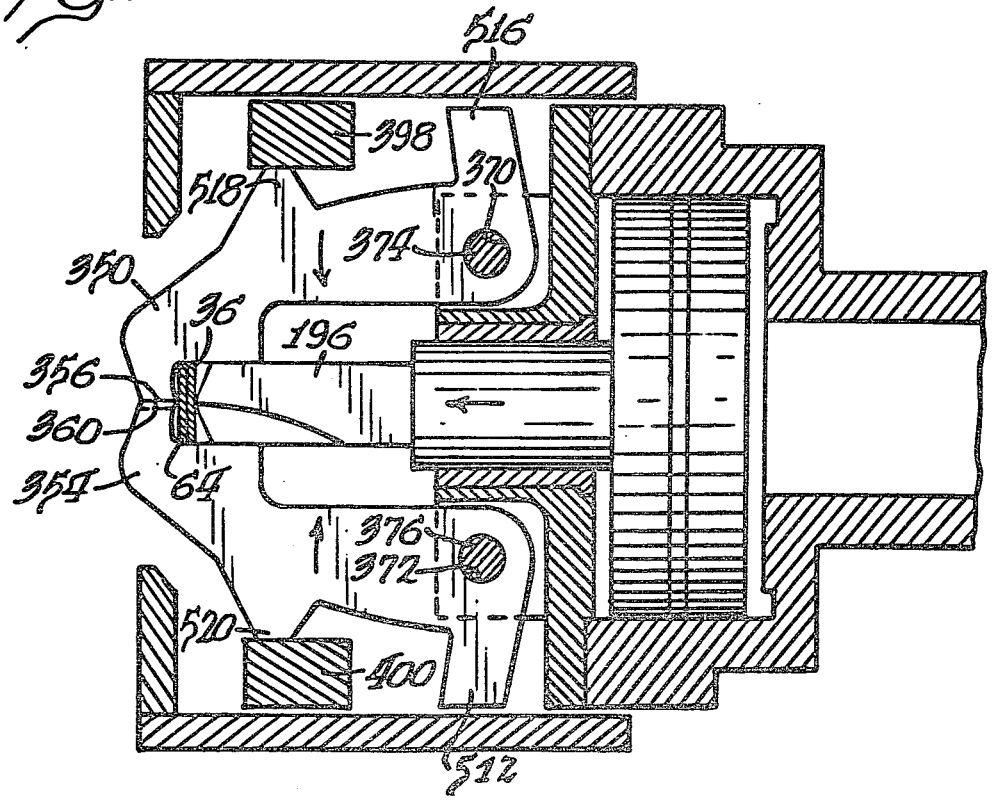
FIG. 10 is a view similar to FIG. 9 showing the notcher jaws and notcher punch in the closed, or punching, position.
Figure 11:
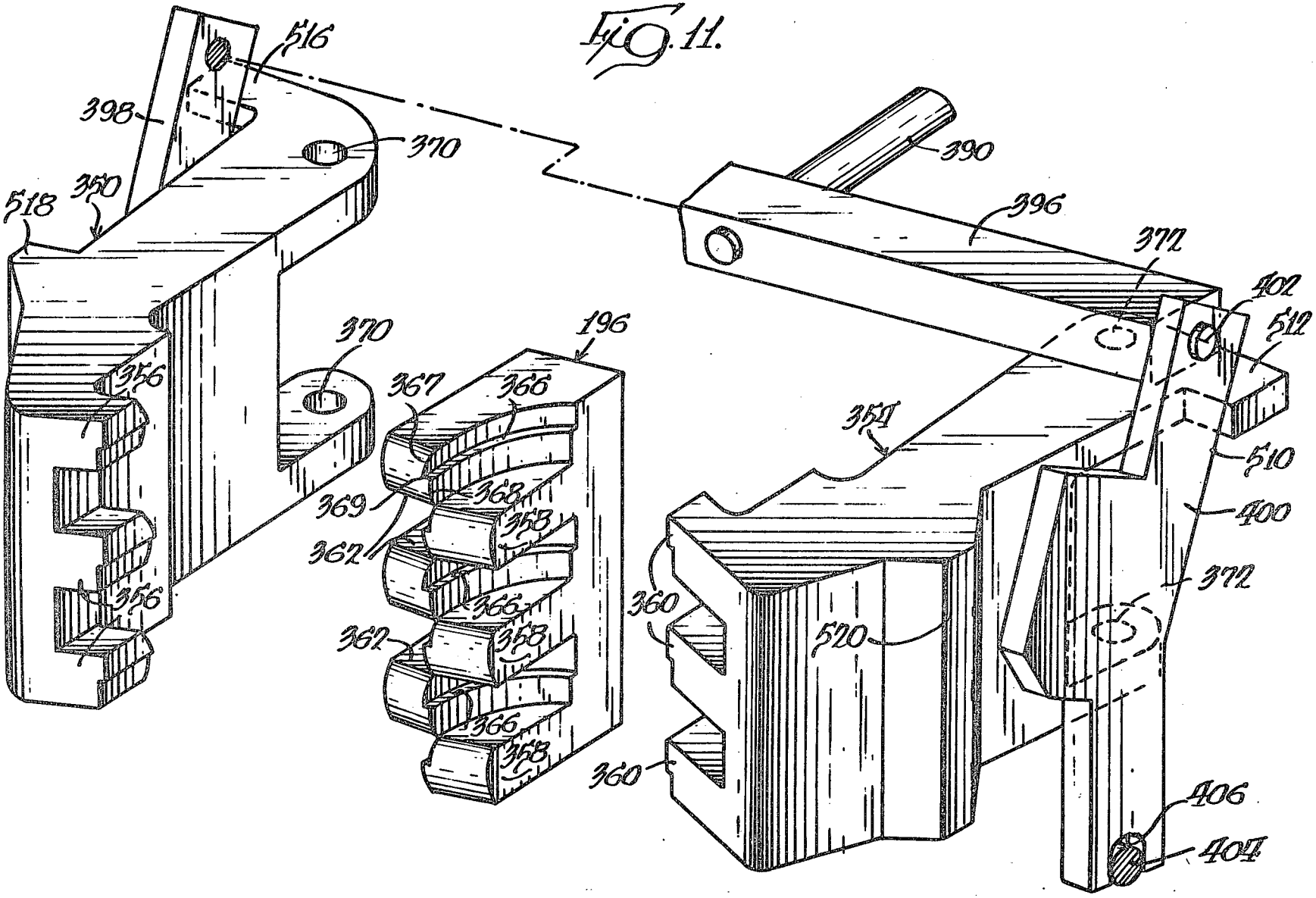
FIG. 11 is an exploded, perspective view of the notcher jaws and notcher punch shown in FIGS. 9 and 10.

The configuration of the jaws assembly and punch is most clearly shown in FIGS. 9, 10, and 11. The punch 196 is centrally located between left jaw 350 and right jaw 354. Left jaw 350 has three teeth 356 which coact with mating teeth 358 on notcher punch 196. Likewise, right jaw 354 has three teeth 360 which coact with mating teeth 362 on notcher punch 196. In the closed position, jaws 350 and 354 enclose notcher punch 196 such that the teeth 356 of jaw 350 and teeth 360 of jaw 354 are arranged in front of, and spaced away from, the teeth of notcher punch 196 as illustrated in FIG. 10 to accommodate the lengths of overlapping strap positioned therebetween. The teeth 356 of jaw 350 are offset with respect to the teeth 360 of jaw 354 as best illustrated in FIG. 4 so that a space is defined between a tooth on one jaw and the sides of two adjacent teeth on the other jaw, that space corresponding to, and being in alignment with, a tooth on the notcher punch 196.

The end surface of each tooth is adapted to bear against the surface of the length of strap lying thereagainst. Thus, as illustrated in FIG. 10, the overlapping lengths of strap can be impressed between the ends of the teeth of the jaws and punch with enough force to restrain them against relative movement while strap tension is released.

The teeth are further adapted to form an interlocking slit-type joint. To this end, a side of each tooth of the jaws 350 and 354 and of the notcher punch 196 has a shoulder which runs the depth of the tooth, such as shoulder 366 shown on teeth 362 of punch 196. The shoulder of each tooth of the notcher punch is adapted to be overridden by a symmetric and oppositely facing shoulder of the respective mating tooth on the jaws 350 and 354. The joint is formed by cutting slits in each overlapped strap length with the leading edges of the teeth on the jaws and punch. The leading edges comprise two long slits 367 and 368 and shoulder edge 369 as illustrated for the top tooth on punch 196 in FIG. 11. When the overlapping lengths of strap are impressed between the notcher punch and the jaws, each tooth of the notcher punch coacts with a mating tooth of one of the jaws so that identical slits are formed in each of the overlapping straps by the leading edges of the teeth. Then when the notcher punch is retracted from the joint area, the residual tension in the loop causes the strap ends to slide against each other so that the slits interlock.

The notcher jaws are automatically moved between the open and closed positions by means of a unique mechanism. As illustrated in FIG. 11, jaw 350 has mounting holes 370 and jaw 354 has mounting holes 372 for receiving pins 374 and 376, respectively (as illustrated in FIG. 9 and FIG. 10). The jaws 350 and 354 are pivotable about these pins 374 and 376, respectively, between the open position illustrated in FIG. 9 and a closed position illustrated in FIG. 10.

Movement of the jaws is effected by a notcher jaw pneumatic piston and cylinder actuator 380 as illustrated in FIGS. 5 and 6 at the top of the strap drive and sealing unit 50. A piston 382 is slidably mounted within a cylinder structure 384 having a removable head plate 386. Plate 386 has a port 388 for admitting pressurized air above the piston. Another port, for admitting air to the underside of the piston, is located in the cylinder structure 384 but is not illustrated. Piston 382 is secured to rod 390 which passes through one end of the cylinder structure 384. O-rings 392 and 394 are provided in the periphery of the piston 382 and in the cylinder structure 384, respectively, to provide proper sealing against air leakage. The jaws are moved by actuator 380 through rod 390 which is connected on the end opposite the piston 382 to a cross bar 396 (as best illustrated in FIG. 11). Cross bar 396 extends to either side above jaw members 350 and 354 and is connected on each end to drive bars 398 and 400. Drive bars 398 and 400 are identically shaped, that shape being best viewed in FIG. 11 with respect to drive bar 400 which is vertically disposed along jaw 354. The drive bar 400 is pivotally connected at the top to cross member 396 with pin 402 and is engaged at the bottom with pin 404 by means of a U-shaped slot 406. Drive bar 400 further has a rear bearing surface 510 for engaging lug 512 on jaw 354 and has a front projection 514 for engaging lug 520 on jaw 354. Drive bar 398 has identical features for engaging lugs 516 and 518 on jaw 350.

The open position of the jaws 350 and 354 is illustrated in FIG. 9. In this position, the bearing surface 510 of drive bar 400 is in engagement with lug 512 of jaw 354 to urge jaw 354 to rotate counterclockwise about its mounting pin 376 to the fully open position. Lug 516 on jaw 350 is engaged in a similar manner by drive member 398 to hold jaw member 350 in the open position. When the cylinder actuator 380 (FIG. 6) is actuated to close the jaws, the piston 382 is forced by the pressurized air within cylinder 384 to the position near the end of the cylinder, essentially as illustrated in FIG. 6, thereby moving piston rod 390 forward, to the left.

As the piston rod 390 moves forward, the cross bar 396 carries the top end of each drive bars 398 and 400 forward so that they pivot about their bottom pins (e.g., pin 404 illustrated for drive bar 400 in FIG. 11) and so that they engage the lugs 518 and 520, respectively, of the jaws 350 and 354, respectively. The jaws are maintained in the closed position by the pneumatic actuator 380 until the strap joint has been completed and until the strap loop has been severed from the trailing portion of strap, at which time the cylinder 384 is pressurized on the underside of the piston 382 while the top side is exhausted so that the jaws are returned to the open position illustrated in FIG. 9 to allow removal of the strapped package.

NOTCHER PUNCH MECHANISM

The notcher punch 196 functions to both (1) hold the overlapping strap lengths against the notcher jaws 350 and 354 to maintain tension in the loop, including in at least one of the strap lengths in the overlapping joint region, during the release of tension from the trailing portion of the strap and (2) subsequently form the interlocking slit-type joint. The notcher punch 196 also carries a cutter mechanism for severing the trailing portion of strap as the joint is being formed.

As shown in FIG. 6, a strap cutter blade 186 is secured to the bottom of the notcher punch 196 by pin 568 and the cutter blade can thus move with the notcher punch to contact the trailing portion of strap. Mounting of the cutter blade 186 on punch 196 eliminates the requirement for a separate cutter blade actuator system. However, it must be remembered that if shock loading upon the formed joint is to be avoided, the strap trailing portion cannot be severed while under tension (with this particular embodiment). Further, to avoid loss of loop tension, it is desirable to form the joint in the overlapping region with the loop under tension and with at least one of the overlapping strap lengths under tension in the joint region. Thus, it is first necessary to grip the overlapping strap lengths between the notcher punch 196 and the jaws 350 and 354 to restrain them against relative movement while the high tension is released in the trailing portion of strap. The notcher punch assembly has been uniquely designed to accomplish this function, as well as to effect subsequent joint formation and movement of the cutter blade 186 to sever the strap. After the high tension has been applied to the strap, the notcher punch 196 is moved fowward to press the overlapped strap lengths against the jaws 350 and 354 (which have been closed from the beginning of the strapping cycle) and restrain the lengths against relative movement with one of the lengths in the joint region under tension as the tension in the trailing strap is released. The strap cutting edge of the cutter blade 186 is set back from the ends of the teeth of the notcher punch 196 by an amount sufficient to prevent severance of the strap during this holding step. Of course, the notcher punch must not be moved against the overlapping strap lengths with such a high force that the coaction of the jaws and punch start to form interlocking slits in the strap and such that the cutter blade 186 severs the strap before tension in the trailing strap length has been released.

The notcher punch 196 is moved against the strap end segment 64 by a notcher punch actuator which comprises a series of interconnected in-line cylinders and pistons. Referring now to FIG. 6, the furthermost cylinder from the punch 196 is shown at the right side of the figure and is designated 530. Slidably disposed within cylinder 530 is a piston 532 which has an O-ring 534 about its periphery to prevent air leakage. Pressurized air can be introduced through ports on either side of piston 532 (not illustrated) into cylinder 530 to effect movement of the piston 523 therein. Piston 532 is secured with screw 536 to oil piston 538. One end of piston 538 is slidably disposed in oil chamber 540 and leakage between the chamber 540 and the cylinder 530 is prevented by seals 542. Preferably, the diameter of the oil piston 538 is smaller than the diameter of the air piston 532 to provide a mechanical advantage for ultimately applying a high force to the notcher punch 196.

The oil chamber 540 communicates on one end with a cylinder 546 in which are slidably disposed two discs, 550 and 552, which are mounted together on rod 554 as a piston. Disc 550 is exposed to the oil from chamber 540 and disc 552 is exposed in cylinder 546 to pressurized air which may be introduced through a port (not illustrated) in cylinder end plate 556. Spacer ring assembly 560, between discs 550 and 552, provides a path to vent any leakage of oil or air past the disc seals 561 and 563 through venting chamber 565 which in turn exhausts to atmosphere through port 567 in the side of notcher punch 196. The notcher punch 196 is connected to rod 554 through an enlarged portion 562 which slides within sleeve 564 and which has an O-ring 566 secured to a groove in its periphery to prevent air leakage therealong.

The rather complex actuator mechanism for the notcher punch 196 has been found effective in providing the high force needed to create an interlocking slit-type joint in the overlapping strap lengths and, before the joint is formed, in holding the notcher punch 196 against the overlapping straps with force sufficient to hold the straps against relative movement (and the loop in tension) but not great enough to form the joint and sever the trailing strap. This is made possible by the use of the double-acting cylinder 530 into which "balancing pressure" is introduced below piston 532 to counterbalance the force being exerted above the piston. To this end, the balancing air introduced into the cylinder 530 reduces the net force being transmitted to the notcher punch 196 so that the force exerted by the notcher punch upon the overlapping strap length lies within an appropriate range.

With the overlapping lengths of strap sufficiently restrained between the jaws 350 and 354 and notcher punch 196, tension can be released in the trailing length of strap. This is done by exhausting the pressure above the piston 324 in the cylinder 326 of the cylinder actuator 164, as was previously described in the section entitled "HIGH TENSION ASSEMBLY".

With the trailing strap length free of tension, the notcher punch 196 is next advanced into the overlapping strap lengths to create the interlocking slit-type joint. To this end, the balancing air is exhausted from the underside of piston 532 so that the full pressure above the piston, increased by mechanical advantage of smaller piston 538, is applied to the notcher punch 196. As the notcher punch is moved forward into the overlapping strap lengths, the teeth on the punch 196 very slightly overlap a portion of the respective mating teeth on the jaws 350 and 354 causing slits to be cut in the strap by the leading edges of the teeth. An interlocking joint is thus formed in the overlapping strap lengths while at least one of the strap lengths (the overlapped segment adjacent the free end segment) is under tension. As the punch 196 nears the end of its forward travel, the cutter blade 186 (FIG. 6) severs the trailing portion of the strap length immediately below the joint. The notcher punch 196 is then returned to its retracted position by exhausting the air pressure above piston 532 and applying the air pressure to the underside of piston 552.

PNEUMATIC CONTROL SYSTEM

Figure 12:
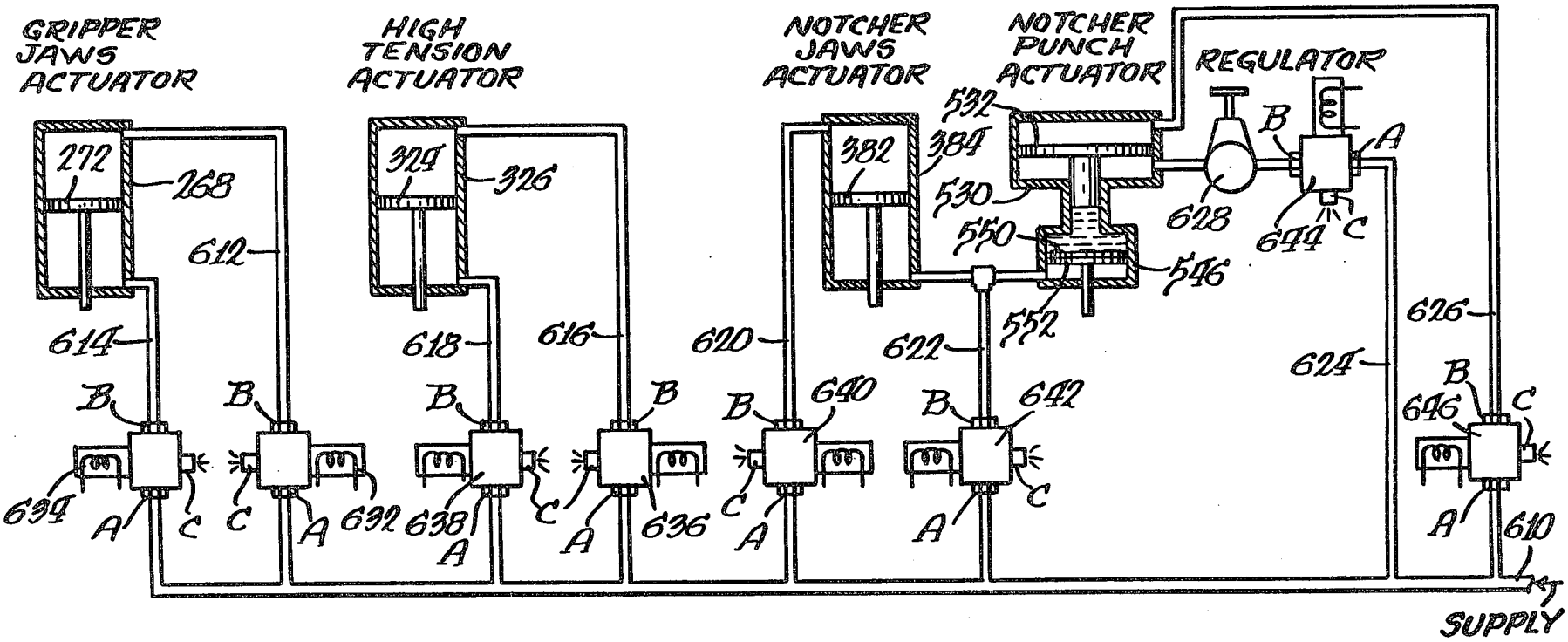
FIG. 12 is a schematic diagram of the pneumatic control system for the apparatus of the present invention.

The pneumatic control system for the apparatus for the present invention is illustrated in FIG. 12. Pressurized air is supplied through manifold 610 to the various pneumatic actuators. Air is supplied from the manifold 610 to the gripper jaws cylinder 268 through conduit pairs 612 and 614, to the high tension cylinder 326 through conduit pairs 616 and 618, to the notcher jaw cylinder 384 through conduit pairs 620 and 622, to the notcher punch oil/air cylinder 546 through conduit 622, and to the notcher punch air cylinder 530 through conduits 624 and 626. Three-way electric solenoid valves 632 through 646 are associated with each conduit 612 through 626, respectively. Each solenoid valve has a pressurized air supply inlet port designated A, a common port designated B, and an exhaust port designated C. A pressure control valve 628 in conduit 624 is provided to supply a balancing air pressure to the underside of piston 532.

At the beginning of a package strapping operation, the apparatus of the present invention is at rest and the strap chute has already been loaded with a length of strap as one of the last steps in the preceding strapping cycle. Also, at the start of the strapping cycle, both the gripper jaws assembly 210 and the notcher jaws assembly 190 are closed, the gripper jaws having been actuated to grip the strap leading end segment to prevent strap overfeed (FIG. 8) and the notcher jaws having been closed (FIG. 10) to provide a guide along which the strap is fed. Both of these jaws assemblies are closed as the last steps in the preceding strapping cycle. Specifically, with reference to FIG. 12, the gripper jaws assembly is closed by maintaining air pressure above piston 272 in cylinder 268 through solenoid valve 632 and by venting the return side of piston 272 through port C of solenoid valve 634. The notcher jaws assembly is maintained closed by admitting air pressure through solenoid valve 640 above piston 382. As a result of a step in the prior cycle, solenoid valve 642 is also open to pressurize the underside of piston 382. However, since the piston rod is connected to the underside of the piston, the pressure bearing surface on the underside of the piston 382 is reduced. Thus, the net force on the piston acts to maintain the jaws assembly closed. However, the notcher punch 196 is in the retracted position as illustrated in FIG. 9. In this retracted position the punch does not bear against the strap but is close enough to act as a guide as the strap is fed therepast.

The package strapping sequence can be automatically performed following an initial signal applied to the apparatus by an automatic package conveying means or by an operator. Through appropriate electrical controls and timers, all operations are sequentially and automatically performed.

A suitable interlock control system is provided, based upon the trip state of the strap feed sensing lever limit switch and the solenoid valve coils, to assure that the strap is properly fed in the chute and gripped by the gripper assembly. If the permissive interlocks are satisfied, the strap feed motor 148 (FIG. 5) starts to rotate the traction wheels 140 and 142, thus drawing the trailing portion of the strap out of the strap chute so the loop tightly encircles the package.

Next, in preparation for drawing high tension, the return side of piston 324 in cylinder 326 is exhausted through port C of solenoid valve 638 (FIG. 12). As was previously explained in detail, as the strap is drawn tightly around the package the high tension assembly 126, under the influence of tension in the strap, rotates clockwise about shaft 144 to trip the limit switch 342 (FIG. 5). The limit switch 342 simultaneously deenergizes motor 148 and actuates solenoid valve 636 to admit pressurized air above piston 324 in cylinder 326. The high tension gripper 162 is thus moved by piston 324 to grip the strap and the continuing downward motion of the piston moves the high tension assembly 126 to apply high tension to the strap. The limit switch 342 also actuates a number of other timers which initiate subsequent machine operations described below.

After a suitable time delay to assure that the desired high tension has been applied to the strap, solenoid valve 642 is actuated to vent the return side of piston 382 in cylinder 384 and the air from the oil/air cylinder 546. This venting assures that the maximum available net force will act upon (1) the piston 382 through pressurization by valve 640 (which has been open to pressurize cylinder 384 and close the notcher jaws since the end of the last cycle) and (2) the piston 532 to move the notcher punch to hold the overlapping strap lengths and subsequently form the joint. After a suitable time delay, solenoid valve 646 is actuated to pressurize cylinder 530 above piston 532 to move the notcher punch 196 forward against the overlapping straps as illustrated in FIG. 10. Also, at the same time, solenoid valve 644 is actuated to pressurize the underside of piston 532 through air pressure regulator 628 to introduce a lower pressure below the piston to provide a "balancing" effect and prevent the notcher punch 196 from cutting into the overlapping strap lengths.

With the overlapping strap lengths sufficiently gripped between the notcher jaws and the notcher punch, the high tension can be released on the trailing portion of strap. After a suitable time delay to assure that the full holding force is being applied to the straps by the notcher punch, solenoid valve 636 is actuated so that air is exhausted from above piston 324 through port C of valve 636 and substantially all tension in the trailing portion of the strap is thereby released. At this point, the tension in the strap loop is thus maintained solely by the notcher punch pressing the strap lengths against the notcher jaws.

With the strap tension released in the trailing portion of the strap, the joint can be formed in the overlapping strap lengths and the trailing portion severed therefrom. After a time delay to assure that the tension has been released from the trailing portion of strap, solenoid valve 644 is actuated to exhaust the balancing air from below piston 532 through port C. Piston 532 is then urged under the total pressure of the air above it to force the notcher punch against the overlapping strap lengths thereby forming the interlocking slits within the overlapping strap length and forcing the cutter blade 186 to sever the trailing portion of the strap.

After a time delay to assure that the strap has been severed, solenoid valves 640 and 646 are actuated to exhaust, through ports C, the air pressure from above pistons 382 and 532, respectively, while solenoid valve 642 is simultaneously actuated to admit pressurized air both below piston 382 and into oil/air cylinder 546, to open, respectively, the notcher jaws and retract the notcher punch. Also at the same time, solenoid valves 632 and 634 are actuated to exhaust the air from above piston 272 and to admit pressurized air below piston 272, respectively, to open the gripper jaws. With the notcher jaws and gripper jaws thus open, the strapped package can be removed from the machine.

After a further time delay, the notcher jaws are again closed, to provide a guide for the new incoming strap, by actuating solenoid valve 640 to pressurize the top of pistion 382. Though solenoid valve 642 is still pressurizing cylinder 384 under piston 382, the force above the piston is greater than that below because the piston rod connection effectively reduces the surface area below the piston. Thus, the piston moves to close the notcher jaws.

A time delay is provided, to assure that the notcher jaws have closed and that the notcher punch has retracted, after which cylinder 326 is pressurized through solenoid valve 638 to move piston 324 upwardly to fully return the high tension assembly 126 to its uppermost position. Then, a new length of strap can be fed into the chute. Appropriate interlocks are provided (based upon the open/close state of strap feed sensing switch and upon the energized/deenergized state of the solenoid valve coils) to prevent strap feeding unless the strapped package has been removed and unless both the gripper and notcher jaws are closed. If these conditions are satisfied, the motor is energized to feed the strap forward past the notcher jaws and into the strap chute to form a loop about the package with the leading end segment re-entering the unit to overlap a portion of the loop. As the leading end segment of the strap travels upwardly, it hits the sensing lever 220 which, through a suitable time delay, switches off, and brakes, the motor. The momentum of the motor carries the leading end segment upwardly past the notcher jaws to provide the correct amount of overlap before the motor comes to a complete rest. Then in order to prevent the strap end segment from subsequently self-feeding beyond the desired amount of overlap when the strap loop flexes inwardly from the corners of the strap chute, the gripper jaws are closed by simultaneous actuation of valves 632 and 634 to vent cylinder 268 below piston 272 and to pressurize the cylinder above the piston. The apparatus is then at rest and is ready for another strapping cycle.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A method for binding an article comprising the steps of:

encircling a strap about the article to form a loop with the leading end segment of the strap overlapping a segment of the strap and with a portion of the strap trailing the loop;

gripping said leading end segment to restrain it against movement relative to said article;

retracting the trailing portion of said strap to tension said strap and to draw said loop tight around said article;

holding said leading end segment and an adjacent overlapped segment of the strap against relative movement and together in surface contact in a region along the segments with at least said adjacent overlapped segment under tension;

releasing tension on the trailing portion of said strap while continuing to hold both said leading end segment and said adjacent overlapped segment of the strap together in surface contact against relative movement with at least said adjacent overlapped segment under tension;

joining said strap leading end segment to an adjacent overlapped segment of the strap under tension in said region of surface contact; and severing the loop from the trailing portion of the strap.

2. A method for binding an article comprising the steps of:

encircling a strap about the article to form a loop with the leading end segment of the strap overlapping a segment of the strap and with a portion of strap trailing the loop;

gripping said leading end segment to restrain it against movement relative to said article;

retracting the trailing portion of said strap to tension said strap and to draw said loop tight around said article;

holding said leading end segment and an adjacent overlapped segment of the strap against relative movement and together in surface contact in a region along the segments with at least said adjacent overlapped segment under tension;

releasing tension on the trailing portion of said strap while continuing to hold both said leading end segment and said adjacent overlapped segment of the strap together in surface contact against relative movement with at least said adjacent overlapped segment under tension; and in the same motion, joining said leading end segment to said adjacent overlapped segment of said strap under tension in said region of surface contact and severing the loop from the trailing portion of the strap.

3. A method for binding an article comprising the steps of:

encircling a strap about the article to form a loop with the leading end segment of the strap overlapping a segment of the strap and with a portion of strap trailing the loop;

gripping said leading end segment to restrain it against movement relative to said article;

retracting the trailing portion of said strap to tension said strap and to draw said loop tight around said article;

holding said leading end segment and an adjacent overlapped segment of the strap against relative movement with at least said adjacent overlapped segment under tension, said step of holding said leading end segment and an adjacent overlapped segment including pressing together the segments in surface contact by (a) engaging at least one anvil member against the surface of said leading end segment which faces said article and (b) pressing a punch member against the surface of an adjacent overlapped segment of the strap which faces away from said article;

releasing tension on the trailing portion of said strap while continuing to hold both said leading end segment and said adjacent overlapped segment of the strap together in surface contact against relative movement with at least said adjacent overlapped segment under tension; and in the same motion, joining said leading end segment to said adjacent overlapped segment of said strap under tension and severing the loop from the trailing portion of the strap.

4. The method in accordance with claim 3 wherein said anvil member and said punch member have coacting teeth for forming an interlocking slit joint and wherein the step of pressing together the strap segments to hold them in surface contact includes exerting a force on the adjacent overlapped segment with said punch member, said force being less than that which would notch interlocking slits into the strap.

5. The method in accordance with claim 4 wherein a cutter blade is mounted on said punch member set back from said teeth and said step of joining and severing includes exerting a force on the adjacent overlapped segment with said punch member sufficient to (a) form an interlocking slit joint between said leading end segment and the adjacent overlapped segment and (b) sever the trailing portion of the strap from the loop.

6. A method for binding an article comprising the steps of:

encircling a strap about the article to form a loop with the leading end segment of the strap overlapping a segment of the strap and with a portion of strap trailing the loop;

gripping said leading end segment to restrain it against movement relative to said article;

retracting the trailing portion of said strap to tension said strap and to draw said loop tight around said article;

holding said leading end segment and an adjacent overlapped segment of the strap against relative movement with at least said adjacent overlapped segment under tension, said step of holding said leading end segment and an adjacent overlapped segment of the strap including pressing together the segments in surface contact by (a) engaging at least one anvil member against the surface of said leading end segment which faces said article and (b) pressing one of an open crimpable seal and a notchable seal against the surface of an adjacent overlapped segment of the strap which faces away from said article;

releasing tension on the trailing portion of said strap while continuing to hold both said leading end segment and said adjacent overlapped segment of the strap together in surface contact against relative movement with at least said adjacent overlapped segment under tension; and in the same motion, joining said leading end segment to said adjacent overlapped segment of said strap under tension and severing the loop from the trailing portion of the strap.

7. A method for binding an article comprising the steps of:

encircling a strap about the article to form a loop with the leading end segment of the strap overlapping a segment of the strap and with a portion of strap trailing the loop;

gripping said leading end segment to restrain it against movement relative to said article;

retracting the trailing portion of said strap to tension said strap and to draw said loop tight around said article;

holding said leading end segment and an adjacent overlapped segment of the strap against relative movement with at least said adjacent overlapped segment under tension, said step of joining and severing including one of the following steps: the step of crimping a seal around said leading end segment of the strap and an adjacent overlapped segment of the strap and the step of notching a seal through said leading end segment of the strap and an adjacent overlapped segment of the strap;

releasing tension on the trailing portion of said strap while continuing to hold both said leading end segment and said adjacent overlapped segment of the strap together in surface contact against relative movement with at least said adjacent overlapped segment under tension; and in the same motion, joining said leading end segment to said adjacent overlapped segment of said strap under tension and severing the loop from the trailing portion of the strap.

8. A method for binding an article with a loop of tensioned strap and for forming a sealless joint between overlapped strap segments in the loop, said method comprising the steps of:

encircling a strap in a chute about the article to form a loop with the leading end segment of the strap overlapping a segment of the strap by a predetermined amount and with a portion of the strap trailing the loop;

gripping said leading end segment after it has overlapped a segment of the strap by said predetermined amount to prevent the strap from self-feeding when the loop flexes inwardly from said chute and for restraining the leading end segment against movement relative to said article;

retracting the trailing portion of said strap to tension said strap and to draw said loop tight around said article;

holding said leading end segment and an adjacent overlapped segment of the strap against relative movement and together in surface contact in a region along the segments with at least said adjacent overlapped segment under tension; and performing only one of the following sequences (a) and (b):

(a) first forming a sealless joint in the overlapping segments of the strap loop in said region of surface contact and then gradually releasing strap tension on the trailing portion of said strap to avoid shock loading, and (b) first releasing strap tension on the trailing portion of said strap and then forming a sealless joint in the overlapping segments in said region of surface contact with at least said adjacent overlapped segment under tension.

9. Apparatus for binding an article with a loop of tensioned strap and for forming a joint between overlapped strap segments in the loop comprising:

means for feeding a length of strap from a supply of strap around the article in a loop so that a leading end segment of the length of strap overlaps a segment of the strap with a portion of the strap trailing the loop;

means for gripping said leading end segment to restrain it against movement relative to said article;

means for retracting the trailing portion of said strap to draw said loop into contact with said article and for applying a predetermined amount of tension to the strap to tighten said loop;

means for releasing strap tension responsive to a given condition;

means for holding said leading end segment and an adjacent overlapped segment together in surface contact in a region along the segments of the strap against relative movement with at least said adjacent overlapped segment under tension during the release of tension on the trailing portion of the strap and subsequent joint formation;

means for joining said leading end segment to an adjacent overlapped segment of the strap in said region of surface contact; and means for severing the loop from the trailing portion of the strap.

10. Apparatus for binding an article with a loop of tensioned metal strap and for forming a sealless strap connection between overlapped strap segments in the loop comprising:

means for feeding a length of metal strap from a supply of strap around the article in a loop so that a leading end segment of the length of strap overlaps a segment of the strap with a portion of the strap trailing the loop;

means for gripping said leading end segment to restrain it against movement relative to said article;

means for retracting the trailing portion of said strap to draw said loop into contact with said article;

tensioning means for applying a predetermined amount of tension to the strap to tighten said loop;

means for releasing tension in the trailing portion of the strap responsive to a given condition;

means for pressing together said leading end segment and an adjacent overlapped segment of the strap to hold the segments in surface contact against relative movement with at least said adjacent overlapped segment under tension during the release of tension in the trailing strap portion and subsequent joint formation;

means for forming an interlocking slit sealless connection under tension between said leading end segment and an adjacent overlapped segment of the strap; and means for severing the loop from the trailing portion of the strap.

11. The apparatus in accordance with claim 10 in which both said means for pressing together the strap segments and said means for forming a sealless connection comprise together a single coacting punch and anvil assembly.

12. The apparatus in accordance with claim 11 in which said punch and anvil assembly comprises a pair of toothed anvil jaws pivotally mounted for movement against the surface of said leading end segment which faces said article and further comprises a movable, toothed punch mounted to reciprocate away from, and into contact against, the surface of an adjacent overlapped segment of the strap which faces away from said article.

13. The apparatus in accordance with claim 12 further including a cutter blade mounted on said toothed punch for movement therewith, said cutter blade having a strap cutting edge set back from the leading edge of the toothed punch by an amount sufficient to prevent severance of the strap when said leading end segment and an adjacent overlapped segment of the strap are pressed together between said punch and said anvil jaws to hold the segments in contact against relative movement during release of tension in the trailing portion of the strap and subsequent joint formation.

14. The apparatus in accordance with claim 13 further including a pneumatic double-acting piston and cylinder actuator connected to reciprocate said punch, said actuator having a single combination pressurizing and exhaust port on one side of the piston for introduction of high pressure to effect joint formation and strap severance and further having a single combination pressurizing and exhaust port on the other side of the piston for introduction of a lower pressure to balance the piston at less than full stroke to urge said punch into contact with said leading end segment whereby said leading end segment and an adjacent overlapped segment of the strap are pressed together between said punch member and said anvil jaws to hold the segments in surface contact against relative movement during release of tension in the trailing portion of the strap before subsequent joint formation and strap severance.

15. The apparatus in accordance with claim 14 further including a hydraulic oil booster cylinder actuator connected in series between said pneumatic actuator and said punch, said pneumatic actuator piston having an extending smaller diameter portion slidably disposed within said hydraulic actuator and in contact with the oil, said hydraulic actuator having disposed therewithin a second, opposing piston in contact with the oil and connected to said punch.

16. The apparatus in accordance with claim 10 in which said tensioning means includes a pneumatic double-acting piston and cylinder actuator connected to a movable strap guide, said guide adapted to contact and bear against the trailing portion of said strap, said actuator having a combination pressurizing and exhaust port on one side of the piston for introduction of high pressure to drive said piston to apply tension through said guide to said strap.

17. The apparatus in accordance with claim 16 in which said means for releasing strap tension includes a pressure release means connected to said port for exhausting the high pressure from said one side of said piston to release the strap tension.

18. Apparatus for binding an article with a loop of tensioned strap and for forming a joint between overlapped strap segments in the loop comprising:

means for feeding a length of strap in a chute around the article to form a loop so that a leading end segment of the length of strap overlaps a segment of the strap by a predetermined amount with a portion of the strap trailing the loop;

means for gripping said leading end segment after it has overlapped a portion of the strap by said predetermined amount to prevent the strap from self-feeding when the loop flexes inwardly from said chute and for restraining the leading end segment against movement relative to said article;

means for retracting the trailing portion of said strap to draw said loop into contact with said article;

tensioning means for applying a predetermined amount of tension in the trailing portion of the strap to tighten said loop;

means for releasing strap tension in the trailing portion of the strap responsive to a given condition;

means for holding said leading end segment and an adjacent overlapped segment of the strap against relative movement and together in surface contact in a region along the segments with at least said adjacent overlapped segment under tension during the release of tension in the trailing strap portion and during subsequent joint formation;

means for joining said leading end segment to an adjacent overlapped segment of the strap in said region of surface contact; and means for severing the loop from the trailing portion of the strap.

19. The apparatus in accordance with claim 18 in which said gripping means comprises a strap end sensing lever movable by said leading end segment, a limit switch responsive to said lever, a gripper jaw, and actuation means for closing, after a predetermined time delay, said gripper jaw upon said leading end segment to prevent further feeding thereof when said limit switch is tripped by said sensing lever being moved by said leading end segment.

* * * * *